US012351371B2

(12) United States Patent
Walters et al.

(10) Patent No.: US 12,351,371 B2
(45) **Date of Patent: *Jul. 8, 2025**

(54) DUAL USE BOX

(71) Applicant: Pratt Corrugated Holdings, Inc., Brookhaven, GA (US)

(72) Inventors: Travis Walters, Atlanta, GA (US); Randy Ball, Peachtree City, GA (US); Hannah Conrad, Memphis, TN (US); Greg Sollie, Sharpsburg, GA (US); Shifeng Chen, Newport News, VA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/899,848

(22) Filed: Sep. 27, 2024

(65) Prior Publication Data

US 2025/0019116 A1 Jan. 16, 2025

Related U.S. Application Data

(63) Continuation of application No. 18/114,762, filed on Feb. 27, 2023, now Pat. No. 12,139,313, which is a (Continued)

(51) Int. Cl.

| | |
|---|---|
| ***B65D 5/54*** | (2006.01) |
| ***B65D 5/02*** | (2006.01) |
| ***B65D 77/32*** | (2006.01) |

(52) U.S. Cl.

CPC ..... *B65D 5/541* (2013.01); *B65D 77/32* (2013.01); *B65D 5/0227* (2013.01); *B65D 2401/10* (2020.05)

(58) Field of Classification Search

CPC .... B65D 5/0263; B65D 5/4279; B65D 5/062; B65D 5/068; B65D 5/064; B65D 5/541; B65D 5/54; B65D 5/4266; B65D 5/0227 (Continued)

(56) References Cited

U.S. PATENT DOCUMENTS

| | | | |
|---|---|---|---|
| 2,692,721 | A | 10/1954 | Pennebaker et al. |
| 3,036,755 | A | 5/1962 | Stone |

(Continued)

FOREIGN PATENT DOCUMENTS

| | | |
|---|---|---|
| DE | 10136111 | 2/2003 |
| DE | 102012007800 | 10/2013 |
| EP | 3446996 | 2/2019 |

OTHER PUBLICATIONS

US 11,273,949 B2, 03/2022, Sollie et al. (withdrawn)

(Continued)

*Primary Examiner* — Christopher R Demeree

(74) *Attorney, Agent, or Firm* — Taylor Duma LLP

(57) ABSTRACT

A dual use box includes a side panel enclosure defining a top end and a bottom end; a first primary top panel extending from the top end of the side panel enclosure and defining a primary overlapping portion and a primary delivery address label; and a second primary top panel extending from the top end of the side panel enclosure and defining a primary underlying portion; wherein: the dual use box is configurable in a primary closed configuration and a secondary closed configuration; in the primary closed configuration, the primary overlapping portion overlays the primary underlying portion, such that the primary delivery address label is visible; and in the secondary closed configuration, the primary underlying portion overlays the primary overlapping portion, such that at least a portion of the primary delivery address label is hidden by the primary underlying portion.

16 Claims, 10 Drawing Sheets

Related U.S. Application Data continuation of application No. 16/818,144, filed on Mar. 13, 2020, now Pat. No. 11,623,785.

(58) Field of Classification Search
USPC ..... 229/132, 138, 137, 140, 117, 103, 184, 229/222, 242
See application file for complete search history.

(56) References Cited

U.S. PATENT DOCUMENTS

D196,883 S 11/1963 Robinson
3,206,101 A 9/1965 Holmes
3,206,102 A 9/1965 Henry, Jr. et al.
3,206,103 A 9/1965 Bixler
3,215,332 A 11/1965 Bess
3,229,890 A 1/1966 Wright
3,235,167 A 2/1966 Svensson
3,239,128 A 3/1966 Rumberger
3,263,899 A 8/1966 Collura et al.
3,295,741 A 1/1967 Meyers
3,306,521 A 2/1967 Giacovas
D211,564 S 7/1968 Balley
D212,683 S 11/1968 Roccaforte et al.
D212,684 S 11/1968 Roccaforte et al.
3,438,566 A 4/1969 Mahon
D214,879 S 8/1969 Roccaforte et al.
D215,414 S 9/1969 Roccaforte
3,563,449 A 2/1971 Forbes, Jr.
3,661,321 A 5/1972 Tessmer, Jr.
3,669,345 A 6/1972 Cote
3,711,012 A 1/1973 Cytron et al.
3,758,023 A 9/1973 Meyers
D232,081 S 7/1974 Zine, Jr.
3,833,165 A 9/1974 Hoiles
3,844,473 A * 10/1974 Whelan ..... B65D 5/0281 229/117.17
3,938,731 A 2/1976 Ross et al.
3,951,332 A 4/1976 Torbeck
3,971,503 A 7/1976 Allan et al.
D243,663 S 3/1977 Booth
4,046,311 A * 9/1977 Voytko ..... B65D 5/2057 229/921
D253,220 S 10/1979 Roccaforte
4,174,041 A 11/1979 Turner
4,180,167 A 12/1979 Leavitt et al.
D255,994 S 7/1980 Roccaforte
D256,437 S 8/1980 Faller et al.
4,230,261 A 10/1980 Austin
D257,830 S 1/1981 Card
D258,049 S 1/1981 Bamburg et al.
D258,271 S 2/1981 Booth et al.
D258,349 S 2/1981 Booth et al.
4,497,433 A 2/1985 Wischusen, III
4,530,459 A * 7/1985 Maroszek ..... B65D 77/042 229/120.32
4,535,928 A 8/1985 Capo
4,535,929 A * 8/1985 Sherman, II ..... B65D 5/103 206/815
D283,593 S 4/1986 Hofer
4,607,786 A 8/1986 Weaver
D293,211 S 12/1987 Depaul et al.
4,752,028 A 6/1988 Ogura
4,819,807 A 4/1989 Giger
4,917,287 A 4/1990 Watson
4,944,405 A 7/1990 Buford et al.
D310,633 S 9/1990 Depaul et al.
D310,784 S 9/1990 Forbes, Jr.
RE33,503 E 12/1990 Schluger
5,020,337 A 6/1991 Kreig
5,326,024 A 7/1994 Fogle
5,346,121 A 9/1994 Beales
5,497,876 A 3/1996 Fleming
5,503,328 A 4/1996 Roccaforte et al.
D374,282 S 10/1996 Hoftman
D394,606 S 5/1998 Zorn et al.
D412,114 S 7/1999 Hansen
5,934,549 A 8/1999 Baumgartner et al.
5,934,550 A 8/1999 Morris
D496,269 S 9/2004 Hutchinson
D503,614 S 4/2005 Sax et al.
7,178,713 B2 2/2007 Stude
D601,419 S 10/2009 Sant' Ana Caceres et al.
D603,258 S 11/2009 Taketomi et al.
7,743,944 B2 6/2010 Ho Fung et al.
7,891,543 B2 2/2011 Abel et al.
8,025,209 B2 * 9/2011 Garner ..... B65D 5/548 229/120.09
8,590,774 B1 11/2013 Sauer
D707,123 S 6/2014 Marchetti et al.
8,807,417 B2 8/2014 Valesini Gegembauer
9,061,477 B2 6/2015 Chandaria
9,714,112 B1 7/2017 Lin
D828,763 S 9/2018 Tan
10,099,807 B2 10/2018 Eisen et al.
10,099,853 B2 10/2018 Miller
D840,219 S 2/2019 Mckenna et al.
10,279,950 B2 5/2019 Chang
10,358,254 B2 7/2019 Buss
10,435,194 B2 10/2019 Sollie et al.
10,472,120 B2 11/2019 Cooper et al.
10,479,547 B2 11/2019 Sumitomo
D877,614 S 3/2020 Sollie et al.
10,618,684 B2 4/2020 Eckert et al.
10,625,898 B2 4/2020 Hodge et al.
10,640,254 B2 5/2020 Oostwouder
D887,265 S 6/2020 Perella et al.
10,683,130 B2 6/2020 Takeuchi
10,723,496 B2 7/2020 Riswick et al.
10,723,505 B2 7/2020 Lopez Masague
D891,919 S 8/2020 Sill et al.
10,766,661 B2 9/2020 Perella et al.
D898,566 S 10/2020 Hughes et al.
D911,164 S 2/2021 Barker
10,981,692 B2 4/2021 Sollie et al.
D919,432 S 5/2021 Muse et al.
11,059,652 B2 7/2021 Sollie et al.
D926,568 S 8/2021 Natsume et al.
11,230,404 B2 1/2022 Sollie et al.
D942,853 S 2/2022 Sollie et al.
D943,412 S 2/2022 Mayer
D946,768 S 3/2022 Kemper et al.
11,312,526 B2 4/2022 Sollie et al.
11,332,274 B2 5/2022 Sollie et al.
D968,950 S 11/2022 Sollie et al.
D977,967 S 2/2023 Sollie et al.
D977,968 S 2/2023 Sollie et al.
D981,847 S 3/2023 Riffe et al.
11,623,785 B2 4/2023 Walters et al.
D988,862 S 6/2023 Turner
11,794,942 B2 10/2023 Sollie et al.
D1,032,358 S 6/2024 Walters et al.
D1,042,124 S 9/2024 Walters et al.
12,077,350 B2 9/2024 Sollie et al.
12,098,000 B2 9/2024 Sollie et al.
12,139,313 B2 11/2024 Walters et al.
2003/0201315 A1 10/2003 Jamison et al.
2005/0145683 A1 7/2005 Alagna et al.
2006/0118605 A1 6/2006 Justice et al.
2008/0083822 A1 4/2008 Benes
2008/0296360 A1 12/2008 Abel et al.
2009/0200324 A1 8/2009 Geelen
2010/0065620 A1 3/2010 Smith
2010/0327048 A1 12/2010 Tsai
2011/0056975 A1 3/2011 Mcgillion
2011/0117258 A1 5/2011 Burke
2012/0091192 A1 * 4/2012 De Paula ..... B65D 71/36 493/162
2016/0122069 A1 * 5/2016 Eisen ..... B65D 5/4233 229/210
2016/0137335 A1 5/2016 Mora
2016/0318654 A1 11/2016 Ayerst et al.
2017/0267395 A1 9/2017 Kansburg
2017/0341802 A1 11/2017 Sumitomo
2018/0105313 A1 4/2018 Buss

(56) References Cited

U.S. PATENT DOCUMENTS

| | | | |
|---|---|---|---|
| 2018/0170610 | A1 | 6/2018 | Buss |
| 2018/0215499 | A1 | 8/2018 | Imai et al. |
| 2018/0354674 | A1 | 12/2018 | Hodge et al. |
| 2019/0077539 | A1 | 3/2019 | Sollie et al. |
| 2020/0148452 | A1 | 5/2020 | Sollie et al. |
| 2020/0172317 | A1 | 6/2020 | Costanzo, Jr. |
| 2020/0239177 | A1 | 7/2020 | Gathercole et al. |
| 2021/0078755 | A1 | 3/2021 | Sollie et al. |
| 2021/0147109 | A1 | 5/2021 | Sollie et al. |
| 2021/0155365 | A1 | 5/2021 | Sollie et al. |
| 2021/0155367 | A1 | 5/2021 | Sollie et al. |
| 2021/0284382 | A1 | 9/2021 | Walters et al. |
| 2021/0347553 | A1 | 11/2021 | Sollie et al. |
| 2022/0242607 | A1 | 8/2022 | Sollie et al. |
| 2022/0332000 | A1 | 10/2022 | Foster et al. |
| 2023/0219712 | A1 | 7/2023 | Walters et al. |
| 2023/0382590 | A1 | 11/2023 | Sollie et al. |
| 2023/0382591 | A1 | 11/2023 | Sollie et al. |
| 2024/0409266 | A1 | 12/2024 | Sollie et al. |

OTHER PUBLICATIONS

Sollie, Greg; Corrected Notice of Allowance for U.S. Appl. No. 16/568,714, filed Sep. 12, 2019, mailed Mar. 15, 2021, 9 pgs.
Sollie, Greg; Final Office Action for U.S. Appl. No. 16/568,714, filed Sep. 12, 2019, mailed Nov. 2, 2020, 10 pgs.
Sollie, Greg; Non-Final Office Action for U.S. Appl. No. 16/568,714, filed Sep. 12, 2019, mailed Jun. 8, 2020, 17 pgs.
Sollie, Greg; Notice of Allowance for U.S. Appl. No. 16/568,714, filed Sep. 12, 2019, mailed Nov. 23, 2020, 5 pgs.
Sollie, Greg; Requirement for Restriction/Election for U.S. Appl. No. 16/568,714, filed Sep. 12, 2019, mailed May 18, 2020, 6 pgs.
Sollie, Greg; Non-Final Office Action for U.S. Appl. No. 17/163,832, filed Feb. 1, 2021, mailed Sep. 27, 2021, 22 pgs.
Sollie, Greg; Notice of Allowance for U.S. Appl. No. 17/163,832, filed Feb. 1, 2021, mailed Jan. 19, 2022, 10 pgs.
Sollie, Greg; Certificate of Correction for U.S. Appl. No. 17/164,883, filed Feb. 2, 2021, mailed Oct. 17, 2023, 1 pg.
Sollie, Greg; Non-Final Office Action for U.S. Appl. No. 17/164,883, filed Feb. 2, 2021, mailed Sep. 28, 2021, 19 pgs.
Sollie, Greg; Notice of Allowance for U.S. Appl. No. 17/164,883, filed Feb. 2, 2021, mailed Jan. 25, 2022, 10 pgs.
Sollie, Greg; Applicant-Initiated Interview Summary for U.S. Appl. No. 17/726,093, filed Apr. 21, 2022, mailed Dec. 30, 2022, 2 pgs.
Sollie, Greg; Certificate of Correction for U.S. Appl. No. 17/726,093, filed Apr. 21, 2022, mailed Dec. 19, 2023, 1 pg.
Sollie, Greg; Non-Final Office Action for U.S. Appl. No. 17/726,093, filed Apr. 21, 2022, mailed Feb. 9, 2023, 24 pgs.
Sollie, Greg; Notice of Allowance for U.S. Appl. No. 17/726,093, filed Apr. 21, 2022, mailed May 23, 2023, 13 pgs.
Sollie, Greg; Requirement for Restriction/Election for U.S. Appl. No. 17/726,093, filed Apr. 21, 2022, mailed Nov. 10, 2022, 6 pgs.
Sollie, Greg; Non-Final Office Action for U.S. Appl. No. 18/233,743, filed Aug. 14, 2023, mailed Apr. 15, 2024, 33 pgs.
Sollie, Greg; Notice of Allowance for U.S. Appl. No. 18/233,743, filed Aug. 14, 2023, mailed Jul. 31, 2024, 9 pgs.
Sollie, Greg; Requirement for Restriction/Election for U.S. Appl. No. 18/233,743, filed Aug. 14, 2023, mailed Apr. 2, 2024, 6 pgs.
Sollie, Greg; Non-Final Office Action for U.S. Appl. No. 18/233,745, filed Aug. 15, 2023, mailed Feb. 22, 2024, 32 pgs.
Sollie, Greg; Notice of Allowance for U.S. Appl. No. 18/233,745, filed Aug. 14, 2023, mailed May 20, 2024, 5 pgs.
Davpack; Article entitled: "ColomPac Premium Instant Base Boxes", located at https://www.davpack.co.uk/postal-packaging/postal-boxes/instant-base-boxes.htm>, accessed on Feb. 14, 2020, 1 pg.
Walters, Travis; Applicant-Initiated Interview Summary for U.S. Appl. No. 16/818,144, filed Mar. 13, 2020, mailed Feb. 16, 2022, 2 pgs.
Walters, Travis; Certificate of Correction for U.S. Appl. No. 16/818,144, filed Mar. 13, 2020, mailed Jun. 27, 2023, 1 pg.
Walters, Travis; Non-Final Office Action for U.S. Appl. No. 16/818,144, filed Mar. 13, 2020, mailed Nov. 16, 2021, 31 pgs.
Walters, Travis; Non-Final Office Action for U.S. Appl. No. 16/818,144, filed Mar. 13, 2020, mailed May 26, 2022, 16 pgs.
Walters, Travis; Notice of Allowance for U.S. Appl. No. 16/818,144, filed Mar. 13, 2020, mailed Dec. 1, 2022, 18 pgs.
Youtube; Images of video for ColomPac CP 155 Premium quick base box, located at <https://www.youtube.com/watch?v=oqw-fGczpS8>, published on Jul. 30, 2015, 7 pgs.
Walters, Travis; Applicant-Initiated Interview Summary for U.S. Appl. No. 18/114,762, filed Feb. 27, 2023, mailed Mar. 14, 2024, 2 pgs.
Walters, Travis; Non-Final Office Action for U.S. Appl. No. 18/114,762, filed Feb. 27, 2023, mailed Dec. 20, 2023, 17 pgs.
Walters, Travis; Non-Final Office Action for U.S. Appl. No. 18/114,762, filed Feb. 27, 2023, mailed Jun. 13, 2023, 33 pgs.
Walters, Travis; Notice of Allowance for U.S. Appl. No. 18/114,762, filed Feb. 27, 2023, mailed Jul. 29, 2024, 16 pgs.
Sollie, Greg; Corrected Notice of Allowance for Design U.S. Appl. No. 29/705,472, filed Sep. 12, 2019, mailed Jun. 17, 2021, 5 pgs.
Sollie, Greg; Non-Final Office Action for Design U.S. Appl. No. 29/705,472, filed Sep. 12, 2019, mailed Feb. 3, 2021, 31 pgs.
Sollie, Greg; Notice of Allowance for Design U.S. Appl. No. 29/705,472, filed Sep. 12, 2019, mailed May 17, 2021, 8 pgs.
Sollie, Greg; Non-Final Office Action for Design U.S. Appl. No. 29/804,166, filed Aug. 18, 2021, mailed Jun. 6, 2022, 33 pgs.
Sollie, Greg; Notice of Allowance for Design U.S. Appl. No. 29/804,166, filed Aug. 18, 2021, mailed Nov. 23, 2022, 17 pgs.
Sollie, Greg; Non-Final Office Action for Design U.S. Appl. No. 29/804,168, filed Aug. 18, 2021, mailed Jun. 6, 2022, 33 pgs.
Sollie, Greg; Notice of Allowance for Design U.S. Appl. No. 29/804,168, filed Aug. 18, 2021, mailed Nov. 23, 2022, 16 pgs.
Dual Use Boxes: Announced (Aug. 17, 2020 (online). Site Visited (Apr. 22, 2023). Available from URL: https://link.usps.com/2020/08/17 /dual-use-boxes/.
Folding Carton: Site Visited (Apr. 22, 2023). Available from URL: https://www.verpacking.com/en/Folding-carton-1-wall310x230x210-din-a4-mm-self-adhesive-return-closure-progressBOX.
Premium System Shipping Transport Carton with SuperFlap: Site Visited (Apr. 22, 2023). Available from URL: https://www.progress-packaging.com/en/products/transport-system-packaging/premium-system-shipping-transport-carton-with-superflap.html.
Walters, Travis; Certificate of Correction for Design U.S. Appl. No. 29/727,831, filed Mar. 13, 2020, mailed Sep. 17, 2024, 1 pg.
Walters, Travis; Ex Parte Quayle Action for Design U.S. Appl. No. 29/727,831, filed Mar. 13, 2020, mailed May 10, 2023, 66 pgs.
Walters, Travis; Notice of Allowance for Design U.S. Appl. No. 29/727,831, filed Mar. 13, 2020, mailed Apr. 8, 2024, 15 pgs.
Walters, Travis; Notice of Allowance for Design U.S. Appl. No. 29/727,831, filed Mar. 13, 2020, mailed Sep. 27, 2023, 14 pg.
alibaba.com; Article entitled: "Custom corrugated carton boxes tear strip tear line zipper self sealing mailer box with self adhesive shipping boxes", located at <https://www.alibaba.com/ product-detail/custom-corrugated-carton-boxes-tear-strip_ 1600104791034.html>, accessed on Jan. 24, 2024, 12 pgs.
Custom Corrugated Packaging Box with Tear Strip: Announced (Dec. 8, 2022; online). Site Visited (Jan. 24, 2024). Available from URL: https://www.giftpackagingbox.com/corrugated-packaging-box-with-tear-strip.html, 4 pgs.
System-Versand-Transportkarton: Announced (Sep. 20, 2020; online). Site Visited (Jan. 24, 2024). Available from URL: https: //www.packster.de/p/system-versand-transportkarton-premium-superflap/B0003276/#itemId=A0003278, 3 pgs.
Walters, Travis; Ex Parte Quayle Action for Design U.S. Appl. No. 29/921,125, filed Dec. 14, 2023, mailed Jan. 30, 2024, 8 pgs.
Walters, Travis; Notice of Allowance for Design U.S. Appl. No. 29/921,125, filed Dec. 14, 2023, mailed Apr. 23, 2024, 26 pgs.
Creative Cartons; Article entitled: "Colompac® intelligent packaging—uniquely designed to save you time, materials and a lot of frustration", located at <https://www.pegasusmediasolutions.com/>, downloaded and publicly available on Mar. 15, 2019, 5 pgs.
Davpack; Images of ColomPac Premium Instant Base Boxes, publicly available prior to Feb. 12, 2020, 5 pgs.

(56) References Cited

OTHER PUBLICATIONS

Blake Purely Packaging: Announced [Apr. 15, 2014]. Site Visited [May 31, 2022]. Available from Internet URL: https://w.amazon.com/Purely-Packaging-PS B500-300x190x40mm-Evident/dp/B00HXB H 9RQ?th = 1, 13 pgs.
Tamper Proof Packaging: Announced [Aug. 14, 2020]. Available from Internet URL: https://www.gwp.co.uk/packaging/ecommerce/tamper-proof/, 4 pgs.
Walters, Travis; Certificate of Correction for U.S. Appl. No. 18/114,762, filed Feb. 27, 2023, mailed Apr. 29, 2025, 1 pg.

* cited by examiner

DUAL USE BOX

CROSS-REFERENCE TO RELATED APPLICATIONS

The present application is a continuation of U.S. patent application Ser. No. 18/114,762, filed Feb. 27, 2023, which is a continuation of U.S. patent application Ser. No. 16/818,144, filed Mar. 13, 2020, which issued as U.S. Pat. No. 11,623,785 on Apr. 11, 2023, each of which is hereby specifically incorporated by reference herein in its entirety.

TECHNICAL FIELD

This disclosure relates to packing. More specifically, this disclosure relates to a dual use box.

BACKGROUND

Buying items online often involves returning said items. Repacking items to return can involve the hassle of keeping the box in which the items arrived, and re-taping the box in preparation for mailing it back. Some people may not have packaging tape available, requiring an additional purchase just to return the item. Damage may also occur to the box during the initial unpacking, rendering the box unsuitable for shipping.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is dual use box comprising a side panel enclosure defining a top end and a bottom end; a first primary top panel extending from the top end of the side panel enclosure and comprising a primary address label and a primary adhesive; a second primary top panel extending from the top end of the side panel enclosure, wherein the primary adhesive is configured to attach the first primary top panel to the second primary top panel; a first secondary top panel extending from the top end of the side panel enclosure and comprising a secondary address label and a secondary adhesive; and a second secondary top panel extending from the top end of the side panel enclosure, wherein the secondary adhesive is configured to attach the first secondary top panel to the second secondary top panel.

Also disclosed is a dual use box comprising a side panel enclosure defining a top end and a bottom end, the top end defining a top opening; and a plurality of top panels at the top end, the top panels configured to selectively cover the top opening, the top panels comprising: a first primary top panel defining an overall width, the first primary top panel defining an overlapping portion, the overlapping portion defining an overlapping width, wherein the overlapping width defines at least half of the overall width; and a second primary top panel defining an underlying portion, the overlapping portion configured to overlay the underlying portion.

Also disclosed is a method for using a dual use box, the method comprising providing the dual use box, the dual use box comprising a side panel enclosure, a first primary top panel, a second primary top panel, a first secondary top panel, and a second secondary top panel; attaching the first primary top panel to the second primary top panel in a primary closed configuration with a primary adhesive; addressing the dual use box on a primary address label of the first primary top panel; opening the dual use box; and attaching the first secondary top panel to the second secondary top panel in a secondary closed configuration with a secondary adhesive; and addressing the dual use box on a secondary address label of the first secondary top panel.

Disclosed is a dual use box includes a side panel enclosure defining a top end and a bottom end; a first primary top panel extending from the top end of the side panel enclosure and comprising a primary adhesive; a second primary top panel extending from the top end of the side panel enclosure, wherein the primary adhesive is configured to attach the first primary top panel to the second primary top panel; a first secondary top panel extending from the top end of the side panel enclosure and comprising a secondary adhesive; a second secondary top panel extending from the top end of the side panel enclosure, wherein the secondary adhesive is configured to attach the first secondary top panel to the second secondary top panel; a primary delivery address label formed separately from and affixed to the first primary top panel; and a secondary delivery address label formed separately from and affixed to the first secondary top panel.

Additionally, disclosed is a dual use box comprising a side panel enclosure defining a top end and a bottom end; a first primary top panel extending from the top end of the side panel enclosure and comprising a primary address label and a primary adhesive; a second primary top panel extending from the top end of the side panel enclosure opposite the first primary top panel, wherein the primary adhesive is configured to attach the first primary top panel to the second primary top panel; a first secondary top panel extending from the top end of the side panel enclosure adjacent to the first primary top panel and comprising a secondary address label and a secondary adhesive; and a second secondary top panel extending from the top end of the side panel enclosure adjacent to the second primary top panel and opposite the first secondary top panel, wherein the secondary adhesive is configured to attach the first secondary top panel to the second secondary top panel.

Also disclosed is a dual use box blank comprising a plurality of substantially planar side panels comprising a first side panel and a second side panel, each of the plurality of substantially planar side panels defining a top end and a bottom end; a first primary top panel extending from the top end of the first side panel and comprising a primary address label and a primary adhesive, the primary adhesive configured to seal the first primary top panel in a primary closed configuration; and a second primary top panel extending from the top end of the second side panel and comprising a secondary address label and a secondary adhesive, the secondary adhesive configured to seal the second primary top panel in a secondary closed configuration, wherein the first and second primary top panels are substantially planar with the plurality of substantially planar side panels.

Furthermore, disclosed is a dual use box comprising a side panel enclosure defining a top end and a bottom end; a first primary top panel extending from the top end of the side panel enclosure and comprising a primary address label; a second primary top panel extending from the top end of the side panel enclosure and comprising instructions for using the dual use box thereon, wherein the first primary top panel is attached to the second primary top panel in a primary closed configuration; a first secondary top panel extending from the top end of the side panel enclosure and comprising a secondary address label; and a second secondary top panel extending from the top end of the side panel enclosure, wherein the first secondary top panel is attached to the second secondary top panel in a secondary closed configuration; wherein the dual use box comprises instructions located thereon for using the dual use box.

Also disclosed is a dual use box comprising a side panel enclosure defining a top end and a bottom end; a first primary top panel extending from the top end of the side panel enclosure and comprising a primary address label, a primary adhesive, and a primary peelable backing covering the primary adhesive; a second primary top panel extending from the top end of the side panel enclosure, wherein the primary adhesive is configured to attach the first primary top panel to the second primary top panel; a first secondary top panel extending from the top end of the side panel enclosure and comprising a secondary address label, a secondary adhesive, and a secondary peelable backing covering the primary adhesive; and a second secondary top panel extending from the top end of the side panel enclosure, wherein the secondary adhesive is configured to attach the first secondary top panel to the second secondary top panel; wherein each of the primary peelable backing comprises instructions printed thereon for removing the primary peelable backing from the dual use box, and the secondary peelable backing comprises instructions printed thereon for removing the secondary peelable backing from the dual use box.

Further disclosed is a dual use box comprising a side panel enclosure defining a top end and a bottom end; a first primary top panel extending from the top end of the side panel enclosure and defining a primary overlapping portion and a primary delivery address label; and a second primary top panel extending from the top end of the side panel enclosure and defining a primary underlying portion; wherein: the dual use box is configurable in a primary closed configuration and a secondary closed configuration; in the primary closed configuration, the primary overlapping portion overlays the primary underlying portion, such that the primary delivery address label is visible; and in the secondary closed configuration, the primary underlying portion overlays the primary overlapping portion, such that at least a portion of the primary delivery address label is hidden by the primary underlying portion.

Additionally, disclosed is a dual use box comprising a side panel enclosure defining a top end and a bottom end, the side panel enclosure comprising a first side panel, a second side panel, a third side panel, and a fourth side panel; a first primary top panel extending from the first side panel at the top end of the side panel enclosure and comprising a primary address label; and a first secondary top panel extending from the second side panel at the top end of the side panel enclosure and comprising a secondary address label; wherein, in a folded configuration of the dual use box: the first side panel is folded to confront the fourth side panel and the second side panel is folded to confront the third side panel; and the first primary top panel and the first secondary top panel face outward such that the primary address label and the secondary address label are visible.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
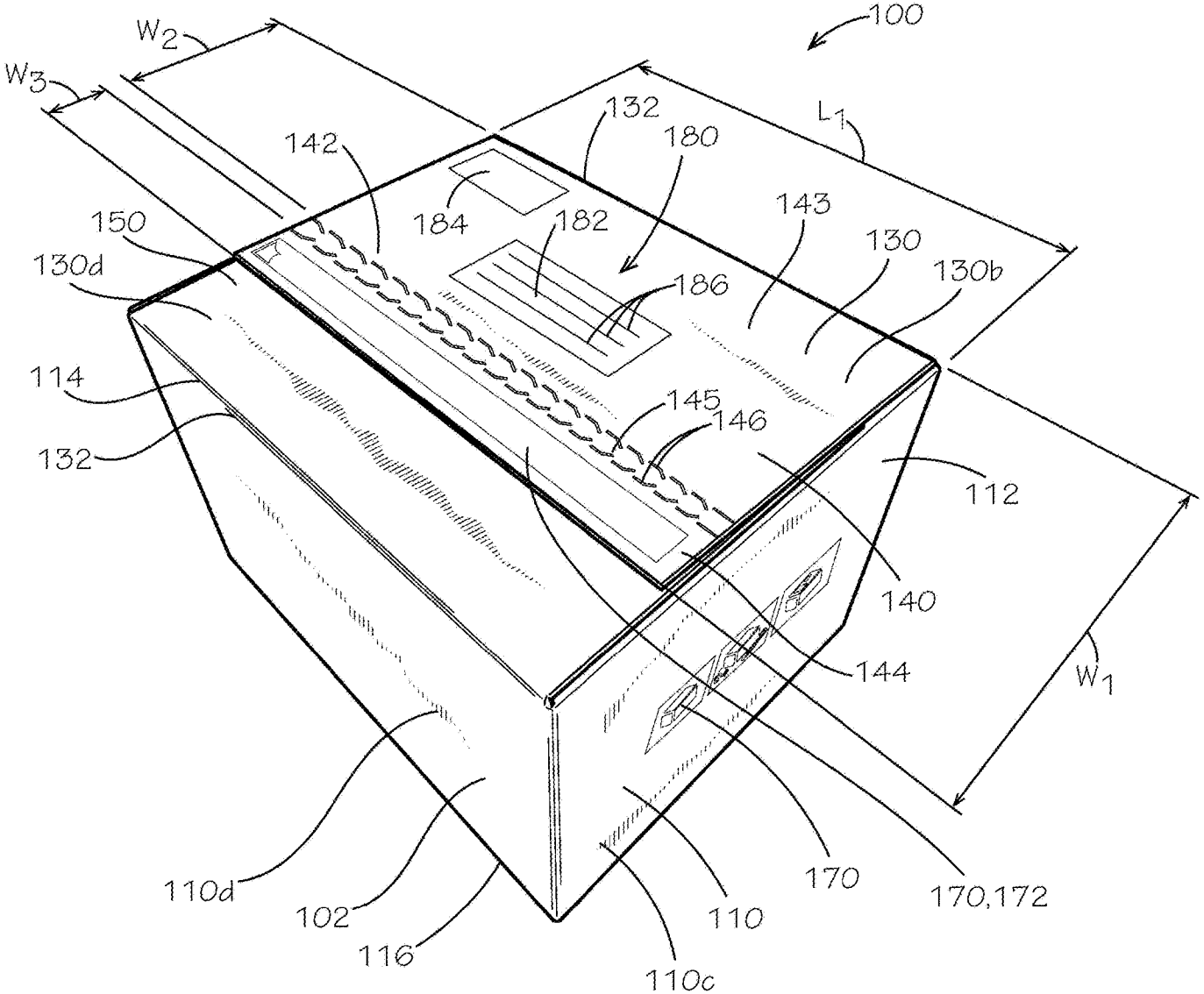
FIG. 1 is a top perspective view of a dual use box in a primary closed configuration, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure.

It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a dual use box and associated methods, systems, devices, and various apparatus. Example aspects of the dual use box can comprise a primary top panel comprising a primary adhesive and a secondary top panel comprising a secondary adhesive. The primary adhesive can seal the dual use box in a primary closed configuration, and the secondary adhesive can seal the dual use box in a secondary closed configuration. It would be understood by one of skill in the art that the dual use box is described in but a few exemplary embodiments among many. No particular terminology or description should be considered limiting on the disclosure or the scope of any claims issuing therefrom.

FIG. 1 is a perspective view of a dual use box 100 in an assembled, erect, and primary closed configuration, in accordance with one aspect of the present disclosure. The dual use box 100 can be configured to easily seal and be used twice (e.g., in the primary closed configuration, as shown, and in a secondary closed configuration, shown in FIG. 8). Example aspects of the box 100 can comprise a plurality of side panels 110 defining a side panel enclosure 112. In the present aspect, the box 100 can comprise four side panels 110 (in particular, a first, second, third, and fourth side panel 110*a,b,c,d*, (110*a,b* shown in FIG. 2*a*) respectively). Only the third and fourth side panels 110*c,d* are shown in FIG. 1. All four side panels 110*a,b,c,d* can be seen in FIG. 2A. Example aspects of the side panel enclosure 112 can define a first end, such as a top end 114, relative to the orientation shown, and a second end, such as a bottom end 116, relative to the orientation shown. A plurality of top panels 130 can extend from the top end 114 of the side panel enclosure 112 to selectively cover and uncover a top opening 215 (shown in FIG. 2A) at the top end 114. In the present aspect, a one of the top panels 130 can extend from each of the side panels 110, such that four top panels 130 are provided (in particular, a first, second, third, and fourth top panel 130*a,b,c,d*, respectively). Only two of the top panels 130*b,d* are shown in FIG. 1. All four top panels 130*a-d* can be seen in FIG. 2A. Furthermore, a plurality of bottom panels 260 (shown in FIG. 2A) can extend from the bottom end 116 of the side panel enclosure 112 and can be folded into a folded bottom panel configuration (shown in FIG. 2A) to selectively cover and uncover a bottom opening 1117 (shown in FIG. 11) at the bottom end 116, as will be described in further detail below.

According to example aspects, a one of the top panels 130*b* can be a first primary top panel 140 and another one of the top panels 130*d* can be an opposing second primary top panel 150. Each of the first and second primary top panels 140,150 can define a length $L_1$ and a width $W_1$. In other aspects, however, the second primary top panel 150 may define a width different from the width $W_1$. The first primary top panel 140 can be configured to partially overlay the second primary top panel 150 in the primary closed configuration, as shown. Each of the first and second primary top panels 140, 150 can be hingedly connected to a corresponding one of the side panels 110 (in particular, the second and fourth side panels 110*b,d*, respectively) by a top panel fold line 132. The first primary top panel 140 can comprise a primary overlapping portion 142 configured to overlay a primary underlying portion 282 (shown in FIG. 2A) of the second primary top panel 150. In example aspects, the primary overlapping portion 142 can comprise a primary adhesive 320 (shown in FIG. 3), such as, for example, a primary tape strip 322 (shown in FIG. 3), which can be removably covered by a primary adhesive cover 220 (shown in FIG. 2A, such as a primary peelable backing 222 strip (shown in FIG. 2A). The primary adhesive 320 can be configured to attach the first primary top panel 140 to the second primary top panel 150 in the primary closed configuration, as will be described in further detail below. Example aspects of the primary adhesive 320 and the primary adhesive cover 220 can extend substantially along the entire length $L_1$ of the first primary top panel 140 in some aspects. In other aspects, the second primary top panel 150 can comprise the primary adhesive 320 for attaching the first primary top panel 140 to the second primary top panel 150 in the primary closed configuration.

According to example aspects, the first primary top panel 140 can define an inner primary top panel flap 143 and an outer primary top panel flap 144. The inner primary top panel flap 143 can be connected to the corresponding side panel 110*b* at the corresponding top panel fold line 132, and the outer primary top panel flap 144 can be distal to the top panel fold line 132. In the present aspect, the inner primary top panel flap 143 can define a width $W_2$ that can be greater than a width $W_3$ of the outer primary top panel flap 144. In some aspects, the outer primary top panel flap 144 can extend to the top panel fold line 132 connecting the second primary top panel 150 to the corresponding fourth side panel 110*d*; however, in other aspects, as shown, the outer primary top panel flap 144 may not extend fully to the top panel fold line 132 of the second primary top panel 150.

In example aspects, as shown, the outer primary top panel flap 144 can be connected to the inner primary top panel flap 143 by a primary tear strip 145. The primary tear strip 145 can extend fully across the length $L_1$ of the first primary top panel 140, as shown; however in other aspects, the primary tear strip 145 may not extend fully across the length $L_1$. According to example aspects, the primary tear strip 145 can be defined by a pair of spaced apart, substantially parallel perforated lines 146. In the aspect shown, the primary overlapping portion 142 of the first primary top panel 140 can comprise the primary tear strip 145 and the outer primary top panel flap 144. In example aspects, each of the perforated lines 146 can each be defined by a series of flap cuts 347 (shown in FIG. 3) and a short, uncut portion 348 (shown in FIG. 3) between each of the flap cuts 347. Other aspects of box 100 may not comprise the primary tear strip 145, but rather can define a single perforated line where the first primary top panel 140 can be torn to separate the outer primary top panel flap 144 from the inner primary top panel flap 143.

Some aspects of the dual use box 100 can comprise indicia 170 thereon. For example, in some aspects, the indicia 170 can be printed on the box 100; in other aspects, the indicia 170 can be otherwise formed on or attached to the box 100. For example, the indicia 170 can be printed on a sticker than can be stuck to the box 100 with an adhesive. In the present aspect, the indicia 170 can comprise instructions 172 for using the dual use box 100. The indicia 170 can be printed (or otherwise formed or attached) on an outer surface 102 of the box 100, as shown, and in some aspects, the indicia 170 can also or alternatively be printed on an inner surface 204 (shown in FIG. 2A) of the box 100. Example aspects of the indicia 170 can comprise graphics, written words, and or any other suitable indicia 170.

Example aspects of the box 100 can further comprise a primary address label 180 on the first primary top panel 140, as shown. The primary address label 180 can be printed on the first primary top panel 140, or otherwise formed on or attached to the first primary top panel 140. In some aspects, the primary address label 180 can comprise a delivery address block 182 and a return address block 184. The delivery address block 182 can be oriented at or near a center of the first primary top panel 140 and the return address block 184 can be oriented at or near an upper left corner of the first primary top panel 140, proximate to the corresponding top panel fold line 132. However, in other aspects, the delivery address block 182 and/or return address block 184 can be oriented elsewhere on the first primary top panel 140. In still other aspects, the delivery address block 182 and/or return address block 184 can be oriented on the second primary top panel 150, provided that the delivery address block 182 and return address block 184 are visible in the primary closed configuration (e.g., the delivery address block 182 and return address block 184 are not oriented on the primary underlying portion 282). Other aspects of the primary address label 180 can comprise only one of the delivery address block 182 and return address block 184, and still other aspects can comprise additional blocks as desired, including but not limited to, a stamp block. In the present aspect, each of the delivery address block 182 and return address block 184 can be formed as rectangular areas within which an address can be written (or printed in some aspects). In some aspects of the box 100, guide lines 186 can be formed within the delivery address block 182 and/or return address block 184 to indicate where and in which orientation the address can be written. As shown, the guide lines 186 can be substantially parallel to one another in some aspects. In other aspects, the delivery address block 182 and/or return address block 184 can define any other suitable shape and may or may not comprise the guide lines 186.

Figure 2A:
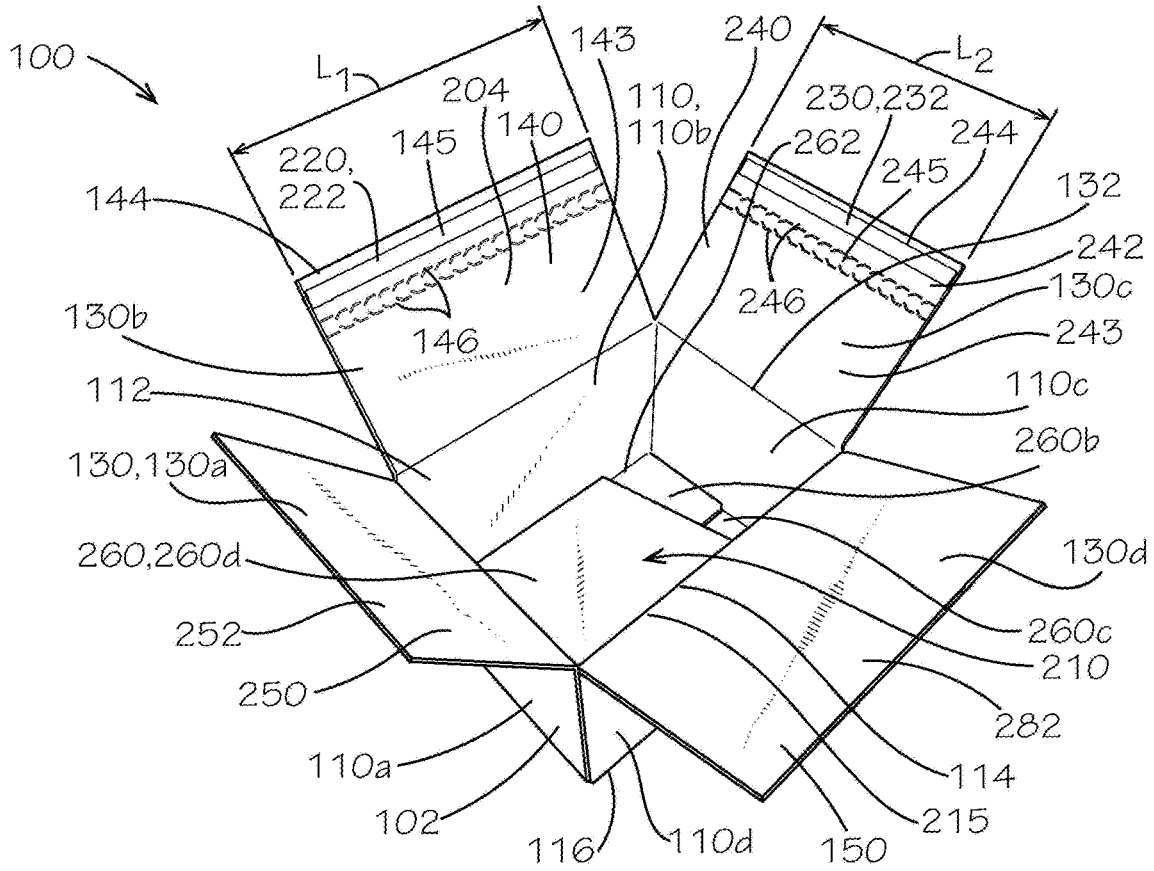
FIG. 2A is a top perspective view of the dual use box of FIG. 1 in an open configuration.
Figure 9:
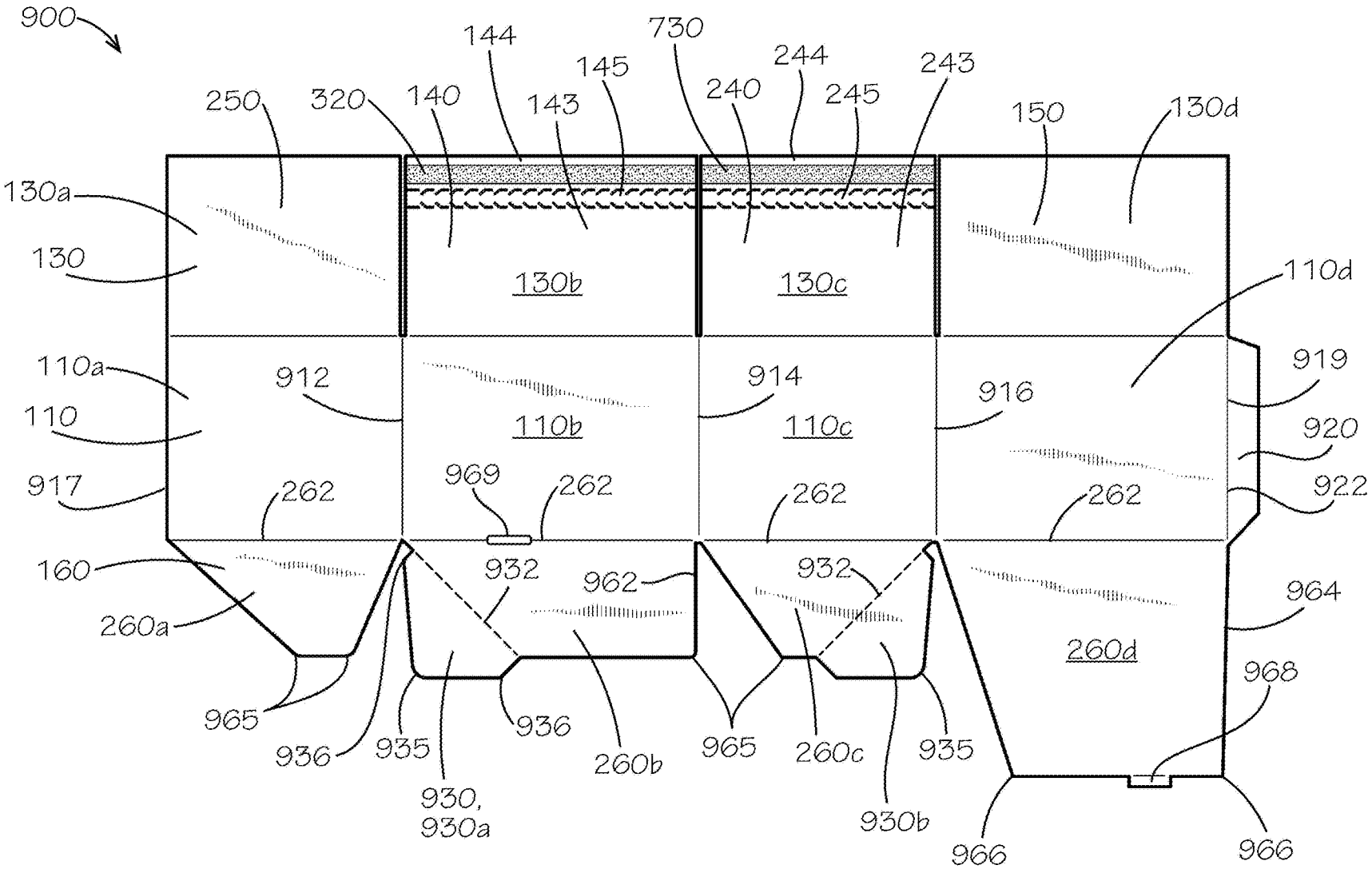
FIG. 9 is a plan view of a blank for the dual use box, according to an aspect of the present disclosure.

FIG. 2A is a top perspective view of the box 100 in an open configuration. As shown, the four side panels 110*a-d* can define the top opening 215 at the top end 114 of the side panel enclosure 112. In the present aspect, the first side panel 110*a* can be disposed opposite the third side panel 110*c*, and the second side panel 110*b* can be disposed opposite the fourth side panel 110*d*. The side panels 110 together, which make up the side panel enclosure 112, can define an interior cavity 210 of the box 100. According to example aspects, the interior cavity 210 of the box 100 can be configured to receive an object or objects therein, such as consumer products. Each of the four top panels 130*a-d* can be folded away from the top opening 215, allowing access to the interior cavity 210 in the open configuration. The bottom panels 260 can be oriented at the bottom end 116 of the side panel enclosure 112 and can be folded to a folded orientation to cover the bottom opening 1117 (shown in FIG. 11). As such, in the open configuration, the interior cavity 210 can be defined by the side panels 110 and bottom panels 260. According to example aspects, the box 100 can comprise four bottom panels 260*a,b,c,d* (260*a* is shown in FIG. 9), and each bottom panel 260*a-d* can extend from a corresponding one of the side panels 110*a-d*, respectively. Each of the bottom panels 260*a-d* can be hingedly connected to the corresponding side panels 110*a-d* by a bottom panel fold line 262. The bottom panels 260 are shown and described in more detail with respect to FIGS. 9-11.

As shown, the top panels 130 can comprise the first primary top panel 140 and the opposing second primary top panel 150. The top panels 130 can further comprise a first secondary top panel 240 and an opposing second secondary top panel 250. Each of the first and second secondary top panels 240,250 can be hingedly connected to a corresponding one of the side panels 110 (in particular, the third and first side panels 110*c,a*, respectively) by a one of the top panel fold lines 132. Example aspects of the box 100 can define a substantially rectangular cross section, wherein the length $L_1$ of the first and second primary top panels 140,150 (and of the corresponding second and fourth side panels 110*b,d*) can be greater than a length $L_2$ of the first and second secondary top panels 240,250 (and of the corresponding third and first side panels 110*c,a*). In other aspects, however, the box 100 can define any suitable cross sectional shape, including but not limited to, square, triangle, pentagon, etc. As such, in other aspects, the box 100 can comprise any other suitable number of side panels 110 and corresponding top and bottom panels 130,260.

As shown, in example aspects, the first primary top panel 140 can comprise the primary adhesive 320 (shown in FIG. 3) covered by the primary adhesive cover 220. The primary adhesive 320 can be oriented on the inner surface 204 of the box 100 and can extend substantially across the length $L_1$ of the first primary top panel 140. According to example aspects, the first secondary top panel 240 can comprise a secondary adhesive 730 (shown in FIG. 7), such as a secondary tape strip 732 (shown in FIG. 7), which can be removably covered by a secondary adhesive cover 230, such as a secondary peelable backing 232 strip. The secondary adhesive 730 can be configured to attach the first secondary top panel 240 to the second secondary top panel 250 in the secondary closed configuration, as shown in FIG. 8 and described in further detail below. Example aspects of the secondary adhesive 730 and the secondary adhesive cover 230 can extend substantially along the entire length $L_2$ of the first secondary top panel 240 in some aspects. In other aspects, the second secondary top panel 250 can comprise the secondary adhesive 730 for attaching the first secondary top panel 240 to the second secondary top panel 250 in the secondary closed configuration.

Example aspects of the first primary top panel 140 can comprise the inner primary top panel flap 143 and the outer primary top panel flap 144 connected together by the primary tear strip 145, as shown. According to example aspects, the first secondary top panel 240 can be formed similarly to the first primary top panel 140. The first secondary top panel 240 can comprise a secondary overlapping portion 242 configured to overlay a secondary underlying portion 252 of the second secondary top panel 250. The first secondary top panel 240 can further comprise an inner secondary top panel flap 243 and an outer secondary top panel flap 244 connected together by a secondary tear strip 245. In example aspects, the secondary overlapping portion 242 of the first secondary top panel 240 can comprise the secondary tear strip 245 and the outer secondary top panel flap 244. The secondary tear strip 245 can extend fully across the length $L_2$ of the first secondary top panel 240, as shown; however in other aspects, the secondary tear strip 245 may not extend fully across the length $L_2$. The secondary tear strip 245 can be defined by a second pair of spaced apart, substantially parallel perforated lines 246, as shown. The perforated lines 246 of the secondary tear strip 245 can formed in a similar matter as the perforated lines 146 of the primary tear strip 145, as described above.

Figure 2B:
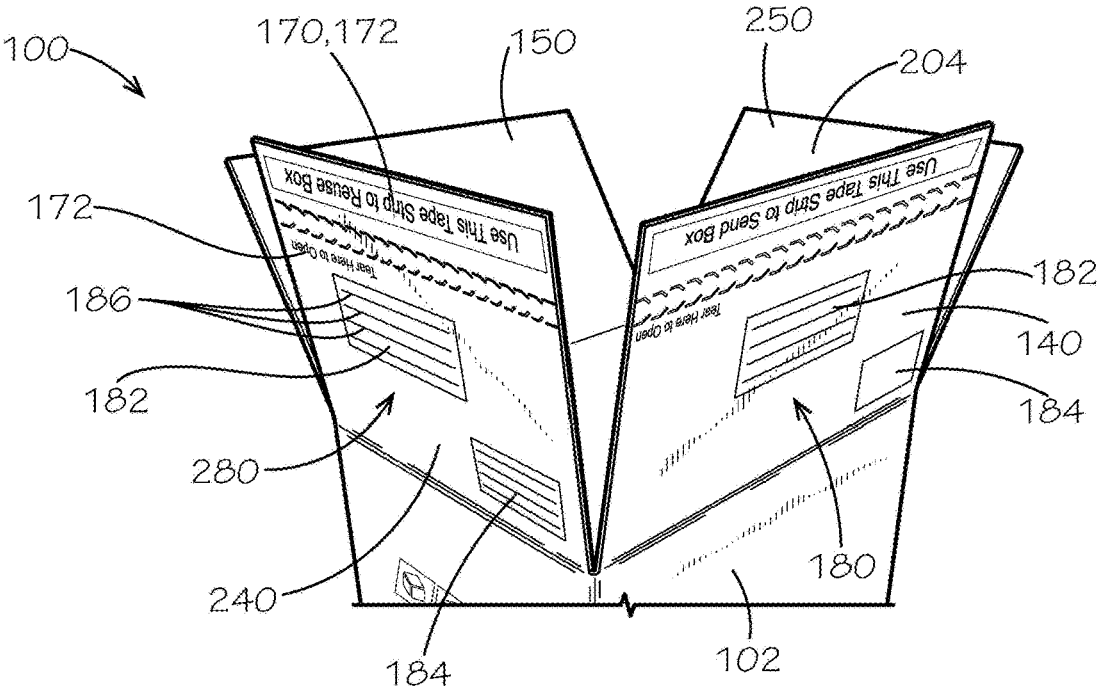
FIG. 2B is another top perspective view of the dual use box of FIG. 1 in the open configuration.

FIG. 2B is a side view of the dual use box 100 in the open configuration. As shown, the first primary top panel 140 can define the primary address label 180 formed on the outer surface 102 of the box 100. According to example aspects, the first secondary top panel 240 can define a secondary address label 280 formed on the outer surface 102 of the box 100. Similar to the primary address label 180, the secondary address label 280 can comprise the delivery address block 182 and the return address block 184. Example aspects of the secondary address label 280 may comprise the guide lines 186 or may not comprise the guide lines 186. In the present aspect, the delivery address block 182 and the return address block 184 of the secondary address label 280 can be substantially similar in appearance and orientation to those of the primary address label 180, but in other aspects, the secondary address label 280 may differ from the primary address label 180. Furthermore, like primary address label 180, the secondary address label 280 may comprise only one of the delivery address block 182 and the return address block 184, or may comprise additional blocks as desired.

In example aspects, one or both of the first primary top panel 140 and first secondary top panel 240 can comprise the indicia 170, such as the instructions 172, printed on the outer surface 102 of the box 100. For example, in the present aspect, each of the first primary and first secondary top panels 140,240 can comprise written instructions for tearing the tear strip away from the box 100. Each of the first primary and first secondary top panels 140,240 can also comprise a graphic and written instructions indicating the location and method for using the corresponding primary and secondary adhesives 320,730 (shown in FIGS. 3 and 7), respectively, which can be oriented on the inner surface 204 of the box 100 opposite the instructions 172.

Figure 3:
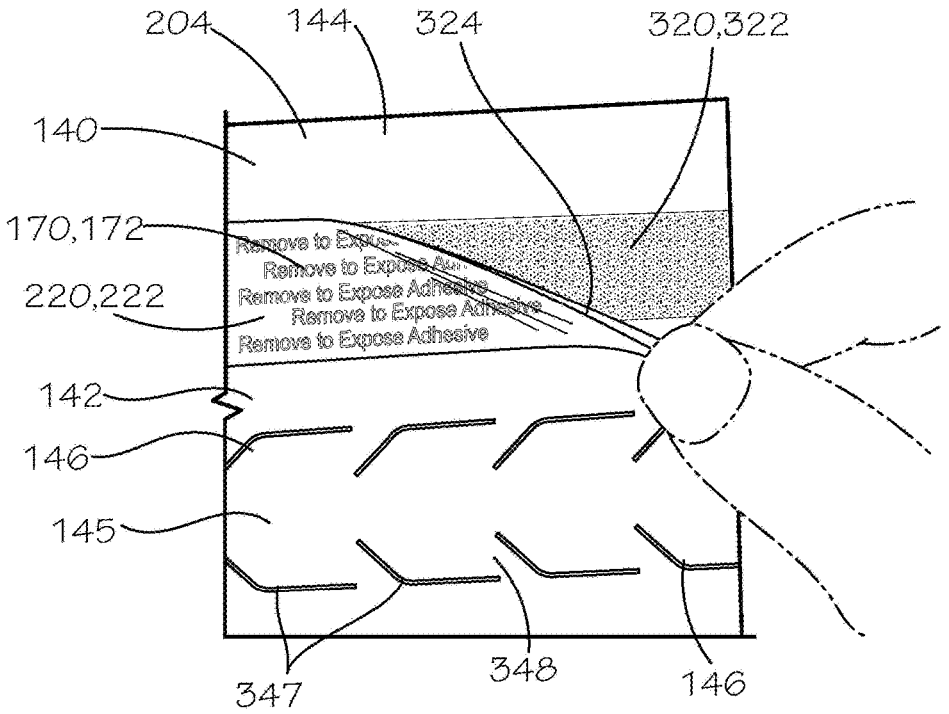
FIG. 3 is a detail view of the dual use box of FIG. 1, showing a primary adhesive cover being removed from a primary top panel.

FIG. 3 is a detail view of the first primary top panel 140, showing an upper right corner thereof. In particular, a portion of the primary overlapping portion 142 of the first primary top panel 140 is shown. As illustrated, the primary adhesive 320 (e.g., the primary tape strip 322) can be oriented on the outer primary top panel flap 144 on the inner surface 204 of the box 100 (shown in FIG. 1). According to example aspects, it can be desirable to seal an object(s) within the interior cavity 210 (shown in FIG. 2A) of the box 100 in the primary closed configuration (shown in FIG. 1). For example, a sender may wish the seal the object(s) in the box 100 for shipping purposes. An example aspect of a method for sealing the box 100 in the primary closed configuration from the open configuration of FIG. 2 can comprise removing the primary adhesive cover 220, such as the primary peelable backing 222, to expose the primary adhesive 320, such as the primary tape strip 322, underneath the primary adhesive cover 220. This can be accomplished by gripping a first end 324 of the primary peelable backing 222 and pulling the first end 324 away from the first primary top panel 140. In some aspects, as shown, the primary peelable backing 222 can comprise indicia 170, such as instructions 172 for removing the primary peelable backing 22 from the first primary top panel 140.

Figure 4:
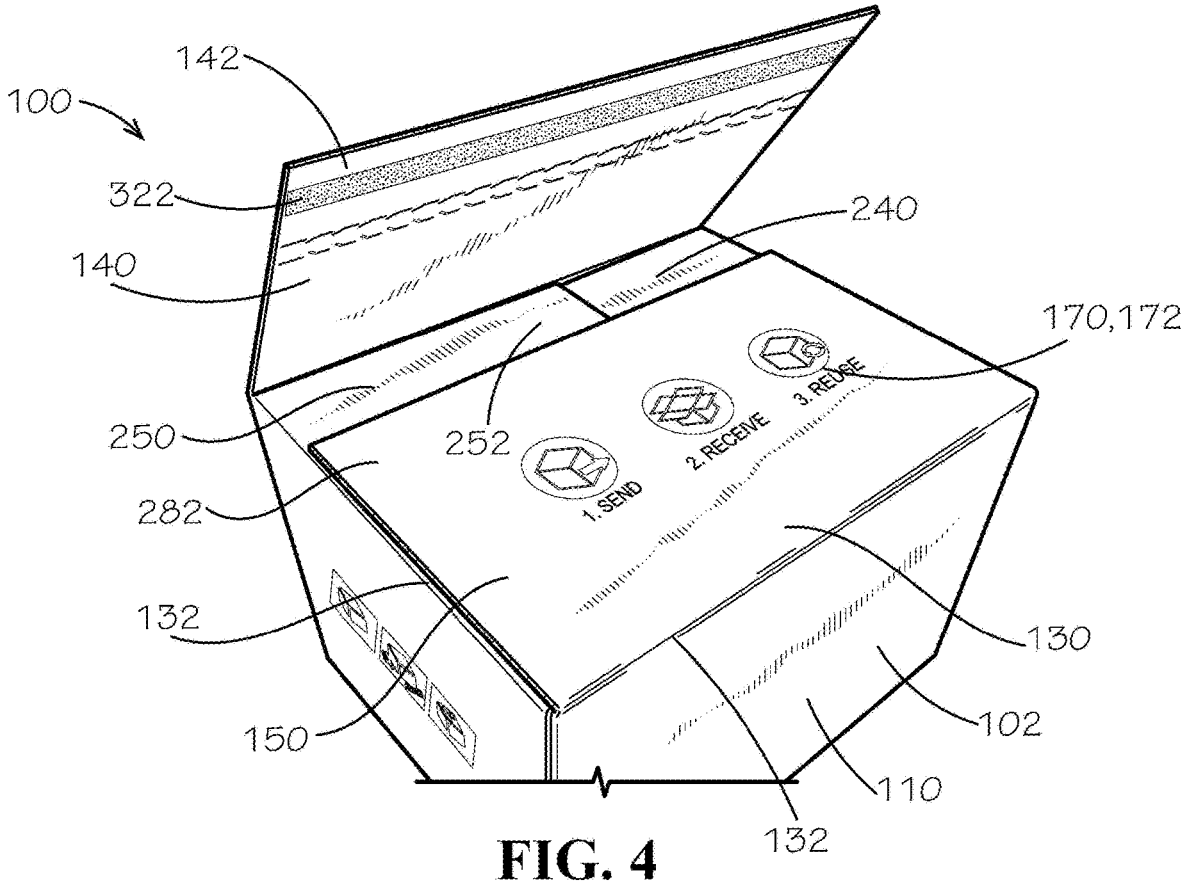
FIG. 4 is a top perspective view of the dual use box of FIG. 1 as it is being closed from the open configuration to the primary closed configuration.

FIG. 4 shows a next step in the method for sealing the dual use box 100 in the closed orientation. The first secondary top panel 240 can be folded at the corresponding top panel fold line 132 towards the interior cavity 210 (shown in FIG. 2A) of the box 100, and the second secondary top panel 250 can be folded at the corresponding top panel fold line 132 over first secondary top panel 240, as shown, or vice versa. In example aspects, the secondary underlying portion 252 of the second secondary top panel 250 can overlay the secondary overlapping portion 242 (shown in FIG. 2A) of the first secondary top panel 240, or vice versa, such that the top opening 215 (shown in FIG. 2A) of the box 100 can be covered and the interior cavity 210 can be completely enclosed. The second primary top panel 150 can then be folded at the corresponding top panel fold line 132 over the first and second secondary top panels 240,250. In other aspects, some or all of the first secondary top panel 240, second secondary top panel 250, and second primary top panel 150 can be folded towards the interior cavity 210 before removing the primary adhesive cover 220 (shown in FIG. 2A). Next, the first primary top panel 140 can be folded over the second primary top panel 150 at the corresponding top panel fold line 132, such that the primary overlapping portion 142 of the first primary top panel 140 can overlay the primary underlying portion 282 of the second primary top panel 150, and the primary tape strip 322 can engage the primary underlying portion 282 to secure the first primary top panel 140 to the second primary top panel 150 in the primary closed configuration. In this configuration, each of the top panels 130 can be oriented at about 90° relative to the side panels 110.

According to example aspects, as shown, the second primary top panel 150 can comprise indicia 170, such as instructions 172, printed on (or otherwise formed on or attached to) the outer surface 102 of the box 100. For example, in the present aspect, the indicia 170 can comprises graphics and written words indicating that the dual use box 100 can be re-used after sealing the box 100 in the primary closed configuration and opening it. In some aspects, the indicia 170 can be formed on the primary underlying portion 282 of the second primary top panel 150, such that it is not visible in the primary closed configuration. In other aspects, the indicia 170 may not be oriented on the primary underlying portion 282 and can be oriented elsewhere on the second primary top panel 150 or elsewhere on the dual use box 100. Still other aspects may not comprise the indicia 170.

Figure 5:
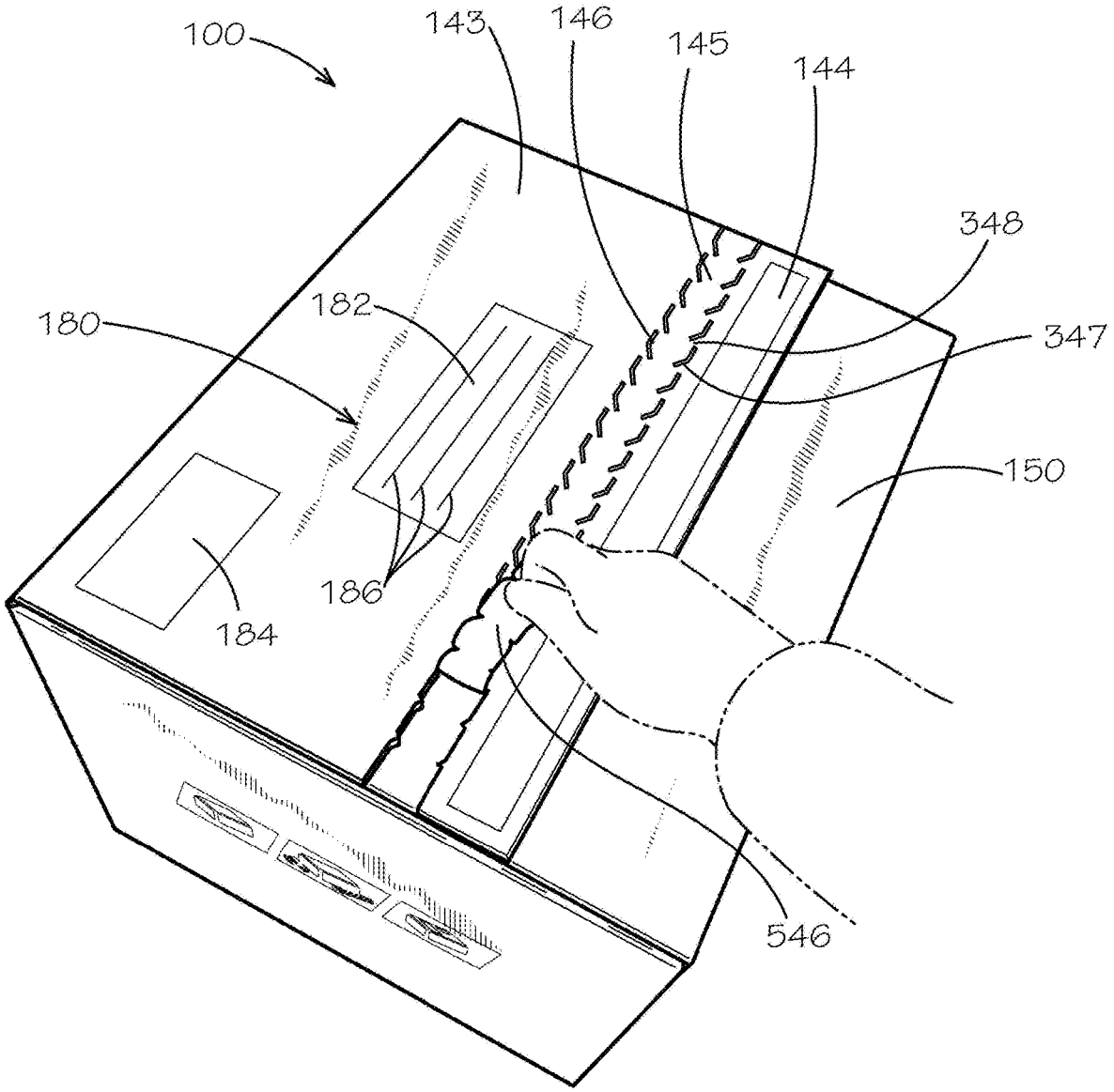
FIG. 5 is a top perspective view of the dual use box of FIG. 1 in the primary closed configuration and showing a primary tear strip being torn.

FIG. 5 illustrates the dual use box 100 in the primary closed configuration. In some aspects, a sender may desire to ship the dual use box 100 from one location to another. For example, a consumer products company may wish to send a product to a customer in the dual use box 100. As shown, in the primary closed configuration, the primary address label 180 comprising the delivery address block 182 and return address block 184 can be visible on the outer surface 102 of the box 100. The sender (e.g., the consumer products company) can write or print the delivery and return addresses in the corresponding delivery and return address blocks 182,184, respectively, and the box 100 can be mailed to a recipient (e.g., the customer) at the delivery address listed on the primary address label 180.

FIG. 5 also illustrates a first step in a method of opening the box 100 after initially sealing the box 100 in the primary closed configuration. In example aspects, the recipient of the box 100—such as, for example, the customer receiving a product housed in the interior cavity 210 (shown in FIG. 2A) of the box 100—can remove the primary tear strip 145 from the box 100 to separate the outer primary top panel flap 144, which is adhered to the second primary top panel 150 by the primary adhesive 320 (shown in FIG. 3), from the inner primary top panel flap 143. The primary tear strip 145 can be removed by gripping a first end 546 of the primary tear strip 145 and pulling the primary tear strip 145 away from the box 100, such that the short uncut portions 348 formed between the flap cuts 347 of the corresponding perforated lines 146 can be torn. The primary tear strip 145 can be pulled away from the box 100 until the primary tear strip 145 is detached from the box 100 and the outer primary top panel flap 144 is disconnected from the inner primary top panel flap 143.

Figure 6:
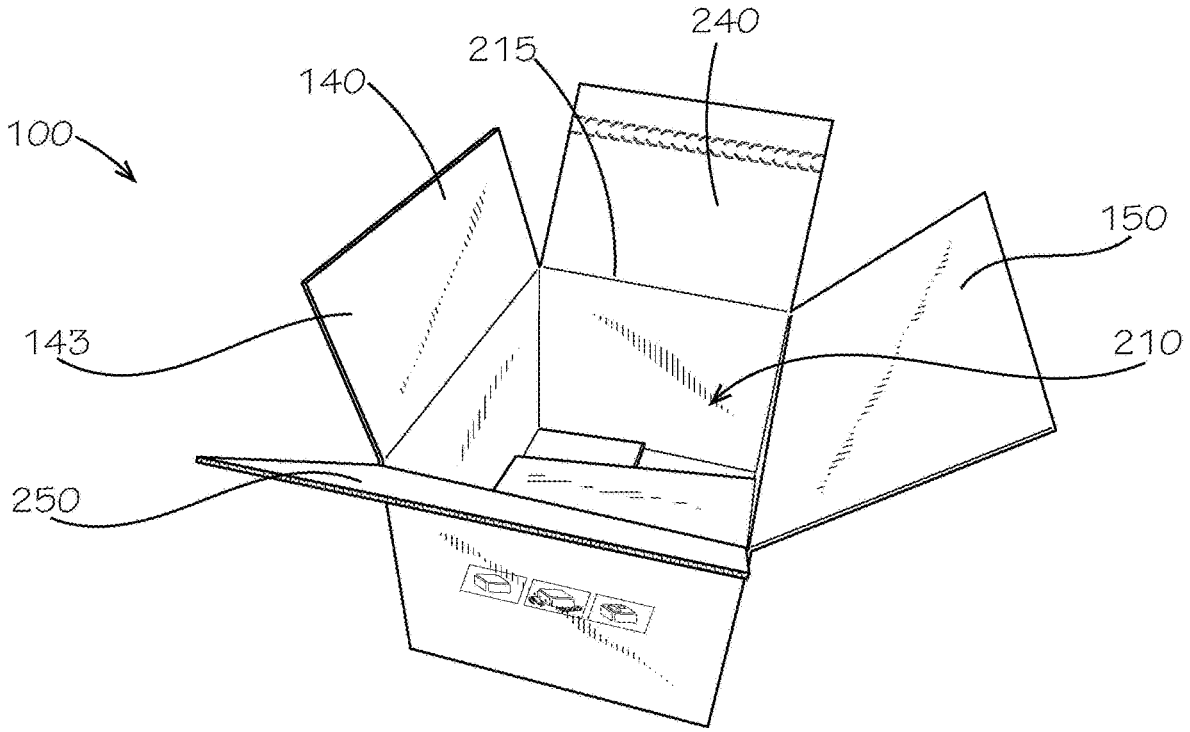
FIG. 6 is a top perspective view of the dual use box of FIG. 1 after it has been reconfigured into the open configuration from the primary closed configuration.

FIG. 6 is a top perspective view of the dual use box 100 after it has been re-configured from the primary closed configuration back to the open configuration. After the primary tear strip 145 (shown in FIG. 1) is removed and the outer primary top panel flap 144 (shown in FIG. 1) is disconnected from the inner primary top panel flap 143, the first and second primary top panels 140,150 and the first and second secondary top panels 240,250 can be folded away from the interior cavity 210 of the box 100 to allow access to the interior cavity 210 through the top opening 215. The outer primary top panel flap 144 can remain adhered to the second primary top panel 150 by the primary adhesive 320 (shown in FIG. 3), and as such, the first primary top panel 140 can now comprise the inner primary top panel flap 143 only. Once re-configured in the open configuration, the object(s) received within the box 100 prior to sealing the box 100 in the primary closed configuration can be removed from the interior cavity 210. In some example aspects, it may be desired to re-use the dual use box 100. For example, a customer who received a product in the box 100 may desire to return the product in the same box 100. As such, the dual use box 100 can be configured such that the same (or different) object(s) can be inserted into the interior cavity 210 and the box 100 can re-sealed in the secondary closed configuration (shown in FIG. 8).

Figure 7:
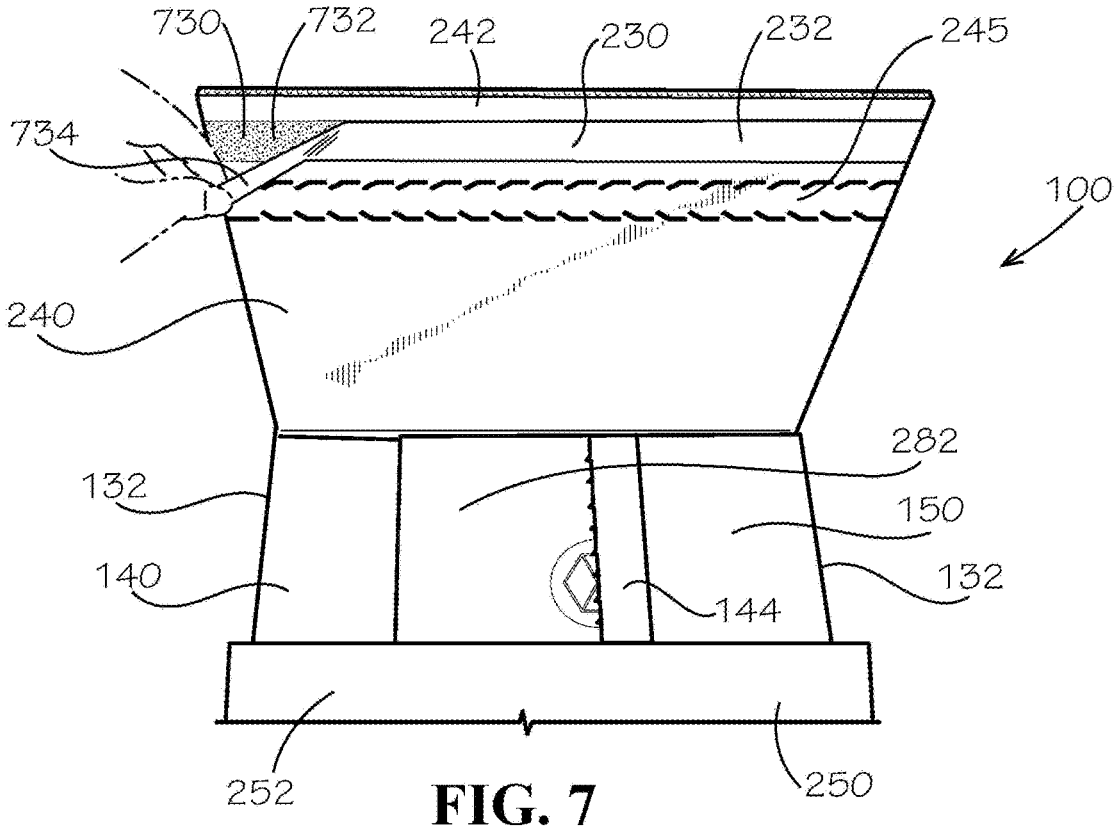
FIG. 7 is a top perspective view of the dual use box of FIG. 1, showing a secondary adhesive cover being removed from a secondary top panel.
Figure 8:
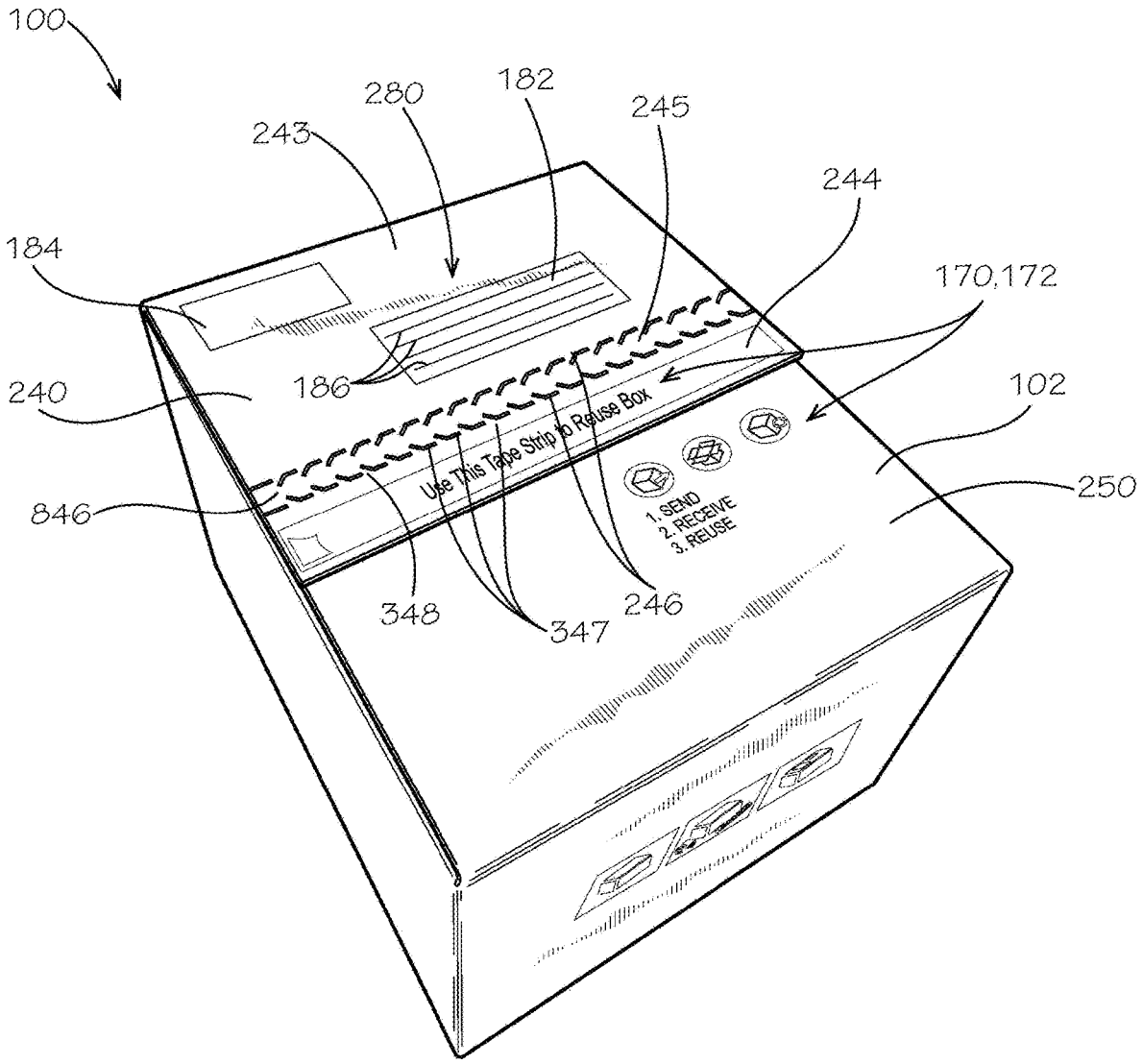
FIG. 8 is a perspective view of the dual use box of FIG. 1 in a secondary closed configuration.

Referring to FIG. 7, to seal the box 100 in the secondary closed configuration, the first primary top panel 140 can be folded at the corresponding top panel fold line 132 towards the interior cavity 210 (shown in FIG. 2A) of the box 100, and the second primary top panel 150 can be folded at the corresponding top panel fold line 132 over first primary top panel 140, as shown, or vice versa. In example aspects, the primary underlying portion 282 of the second primary top panel 150 can overlay the primary overlapping portion 142 (shown in FIG. 1) of the first primary top panel 140, or vice versa, such that the top opening 215 (shown in FIG. 2A) of the box 100 can be covered and the interior cavity 210 can be completely enclosed. The second secondary top panel 250 can then be folded at the corresponding top panel fold line 132 over the first and second primary top panel 150.

In the present aspect, a next step in sealing the box 100 in the secondary closed configuration can comprise removing the secondary adhesive cover 230, such as the secondary peelable backing 232, from the box 100 to expose the secondary adhesive 730, such as the secondary tape strip 732, behind the secondary adhesive cover 230. This can be accomplished by gripping a first end 734 of the secondary peelable backing 232 and pulling the first end 734 away from the first secondary top panel 240. In other aspects, some or all of the first primary top panel 140, second primary top panel 150, and second secondary top panel 250 can be folded towards the interior cavity 210 after removing the secondary adhesive cover 230. Next, the first secondary top panel 240 can be folded over the second secondary top panel 250 at the corresponding top panel fold line 132, such that the secondary overlapping portion 242 of the first secondary top panel 240 can overlay the secondary underlying portion 252 of the second secondary top panel 250. The secondary tape strip 732 can engage the secondary underlying portion 252 to secure the first secondary top panel 240 to the second secondary top panel 250 in the secondary closed configuration.

FIG. 8 illustrates the dual use box 100 in the secondary closed configuration. In some aspects, the recipient may desire to ship the dual use box 100 again from one location to another. As shown, in the secondary closed configuration, the secondary address label 280 comprising the delivery address block 182 and return address block 184 can be visible on the outer surface 102 of the box 100. The recipient can write the delivery and return addresses in the corresponding delivery and return address blocks 182, 184, respectively, and the box 100 can be mailed to the delivery address listed on the primary address label 180. For example, in a particular aspects, as described above, the recipient can be a customer who desires to return a product that was shipped to them in the dual use box 100 back to the sender.

According to example aspects, a consequent recipient of the dual use box 100 in the secondary closed configuration can remove the secondary tear strip 245 from the box 100 to reconfigure the box 100 in the open orientation (shown in FIG. 2A) and to access the interior cavity 210 (shown in FIG. 2A). The consequent recipient can be, for example, the consumer products company, which can receive the returned product in the dual use box 100. The secondary tear strip 245 can be removed from the box 100 in the same manner that the primary tear strip 145 was removed. For example, the secondary tear strip 245 can be removed by gripping a first end 846 of the secondary tear strip 245 and pulling the secondary tear strip 245 away from the box 100, such that the short uncut portions 348 formed between the flap cuts 347 of the corresponding perforated lines 246 can be torn. The secondary tear strip 245 can be pulled away from the box 100 until the secondary tear strip 245 is detached from the box 100 and the outer secondary top panel flap 244 is disconnected from the inner secondary top panel flap 243. The first and second primary top panels 140,150 (shown in FIG. 1) and the first and second secondary top panels 240,250 can then be folded away from the interior cavity 210 (shown in FIG. 2A) of the box 100 to allow access to the interior cavity 210 through the top opening 215 (shown in FIG. 2A).

Several advantages are realized by the dual use box 100 as disclosed above. When the box 100 arrives to the recipient (e.g., the customer) and the consequent recipient (e.g., the original sender), the primary and secondary tear strips 145,245 can easily be seen, suggesting that they be torn, even without instructions. The perforated lines 146,246 of the primary and secondary tear strips 145,245 can be easily torn with minimal effort. Furthermore, after the box 100 is re-opened from the primary closed configuration, only the secondary adhesive cover 230 remains, suggesting that it can be removed to allow for re-sealing the box 100 in the secondary closed configuration. Furthermore, in some aspects, indicia 170, such as instructions 172 for opening and sealing/resealing the box 100, can be printed on the box 100 itself, to further support ease of use.

FIG. 9 is a plan view of a blank 900 for the dual use box 100, according to example aspect of the present disclosure. Various components of the box 100 that have been previously introduced can be seen in this configuration. For example, the side panels 110*a-d*, the top panels 130*a-d* (including the first and second primary top panels 140,150 and the first and second secondary top panels 240,250), and the bottom panels 260*a-d* are visible. The primary tear strip 145 of the first primary top panel 140 connects the inner primary top panel flap 143 to the outer primary top panel flap 144, and the secondary tear strip 245 of the first secondary top panel 240 connects the inner secondary top panel flap 243 to the outer secondary top panel flap 244. The primary adhesive 320 and the secondary adhesive 730 can be oriented on the outer primary top panel flap 144 and outer secondary top panel flap 244, respectively.

According to example aspects, the first side panel 110*a* can be connected to the second side panel 110*b* at a first side panel fold line 912, the second side panel 110*b* can be connected to the third side panel 110*c* at a second side panel fold line 914, and the third side panel 110*c* can be connected to the fourth side panel 110*d* at a third side panel fold line 916. In the assembled configuration (shown in FIG. 1), the side panels 110 can be folded at the corresponding side panel fold lines 912,914,916 to form the rectangular cross-sectional shape. An outer side edge 917 of the first side panel 110*a* can be oriented adjacent an outer side edge 919 of the fourth side panel 110*d* in the assembled configuration, and a connector strip 920 can be provided for securing the box 100 in the assembled configuration. In the present aspect, the connector strip 920 can extend from the outer side edge 919 of the fourth side panel 110*d*; however, in other aspects the connector strip 920 may extend from the outer side edge 917 of the first side panel 110*a*. The connector strip 920 can be hingedly connected to the fourth side panel 110*d* at a connector strip fold line 922, as shown, and in the assembled configuration, the connector strip 920 can be folded at the connector strip fold line 922 and attached to the first side panel 110*a*. The connector strip 920 can be attached to the first side panel 110*a* at either the outer surface 102 or the inner surface 204 of the box 100. In example aspects, a fastener, such as, for example, an adhesive, can be used to attach the connector strip 920 to the first side panel 110*a*. The adhesive can be any suitable adhesive, including but not limited to, hot melt, tape, and glue. In other aspects, any other suitable fastener can attach the connector strip 920 to the first side panel 110*a*.

The first, second, third, and fourth bottom panels 260*a-d* can be connected to the first, second, third, and fourth side panels 110*a-d*, respectively, at the bottom end 116 of the side panel enclosure 112 (shown in FIG. 1) by the corresponding bottom panel fold lines 262. In the present aspect, each of the bottom panels 260 can define a substantially trapezoidal shape. For example, the first and third bottom panels 260*a,c* can define an acute trapezoidal shape, while the second and fourth bottom panels 260*b,d* can define a right trapezoidal shape. In some aspects, the second bottom panel 260*b* can define a corresponding right edge 962 that can be substantially in line with the second side panel fold line 914, and the fourth bottom panel 260*d* can define a corresponding right edge 964, relative to the orientation shown, that can be substantially in line with the outer side edge 919 of the fourth side panel 110*d*. Each of the bottom panels 260 can define one or more corners. In some aspects, some of the corners can be rounded corners 965 and some of the corners can be sharp corners 966, as shown. In other aspects, all of the corners can be rounded corners 965 or all of the corners can be sharp corners 966. Also in other aspects, some or all of the bottom panels 260 can define any other suitable trapezoidal shape, while in still other aspects, some or all of the bottom panels 260 can define a shape other than trapezoidal, including but not limited to, triangular, rectangular, or the like.

Figure 10A:
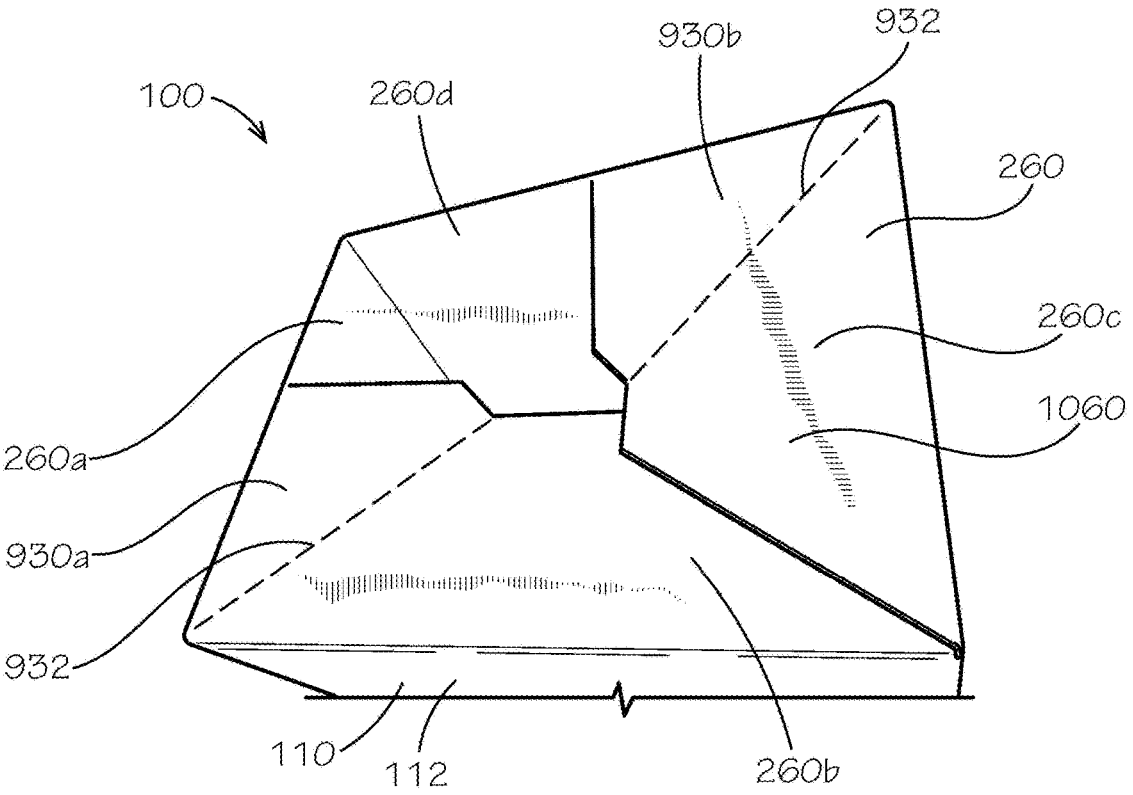
FIG. 10A is a bottom perspective view of the dual use box of FIG. 1.
Figure 10B:
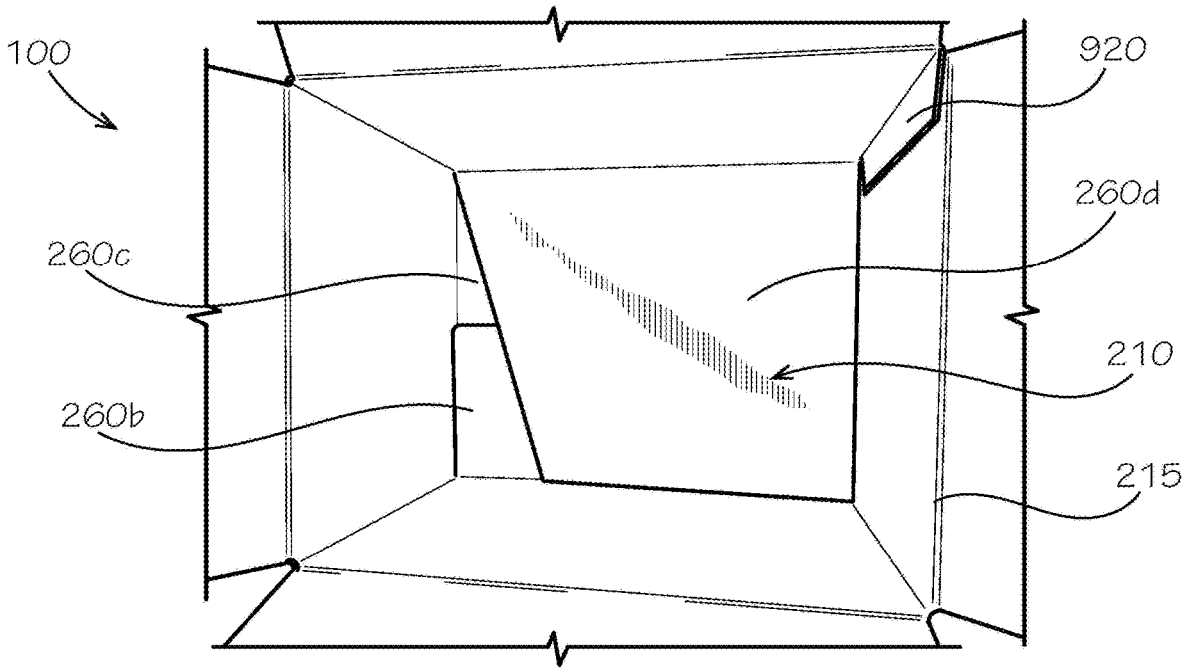
FIG. 10B is a top view the dual use box of FIG. 1.

As shown, in some example aspects, a fastener flap 930 (e.g., fastener flaps 930*a*,930*b*) can extend from each of the second and third bottom panels 260*b,c*, respectively. In other aspects, one or both of the fastener flaps 930*a,b* can extend from a different one of the bottom panels 260. Furthermore, in other aspects, more or fewer of the bottom panels 260 can comprise a one of the fastener flaps 930 extending therefrom. Each of the fastener flaps 930*a,b* can be connected to the corresponding second or third bottom panel 260*b,c* at a fastener flap fold line 932, as shown. In some aspects, the fastener flap fold lines 932 can each be oriented at about 45° relative to the bottom panel fold line 262 of the corresponding second or third bottom panel 260*b,c*. In the present aspect, each of the fastener flaps 930*a,b* can define a substantially pentagonal shape. Each of the fastener flaps 930*a,b* can define a plurality of corners, wherein an apex corner 935 of each fastener flap 930*a,b* can be rounded and the remaining corners 936 of the fastener flap 930*a,b* can be sharp. Other aspects of the fastener flaps 930 can define any other suitable shape, and some or all of the corners 935 can be rounded and/or sharp. According to example aspects, a fastener, such as an adhesive (e.g., glue), can be applied to each of the fastener flaps 930*a,b*. The bottom panels 260 can be folded into the folded bottom panel configuration, as shown in FIGS. 2A, 10A, and 10B, wherein the bottom panels 260 can cover the bottom opening 1117 (shown in FIG. 11) at the bottom end 116 of the dual use box 100. In example aspects, the adhesive of the fastener flap 930*a* of the second bottom panel 260*b* can attach the fastener flap 930*a* to the first bottom panel 260*a* and the adhesive of the fastener flap 930*b* of the third bottom panel 260*c* can attach the fastener flap 930*b* to the fourth bottom panel 260*d* to secure the bottom panels 260 in the folded bottom panel configuration.

In some aspects, one or more of the bottom panels 260 can define one or more tabs 968 extending from a distal end thereof. For example, in the present aspect, the fourth bottom panel 260*d* can define one tab 968 extending therefrom. Furthermore, the dual use box 100 can define one or more slots 969 configured to receive a corresponding tab 968 in the folded bottom panel configuration, as described in further detail below. For example, in the present aspect, one slot 969 can be formed at the bend line 262 formed between the second side panel 110*b* and the second bottom panel 260*b*. In other aspects, the slot 969 can be formed proximate to the bend line 262 on either the second side panel 110*b* or the second bottom panel 260. As shown, in the present aspect, the dual use box 100 can define a single tab 968 and a single corresponding slot 969. However, in other aspects, the dual use box 100 can comprise additional tabs 968 extending from any of the bottom panels 260 and can define additional corresponding slots 969. In some aspects, the number of tabs 968 and corresponding slots 969 provided can be dependent on the size of the dual use box 100. For example, in a particular aspect, wherein the dual use box 100 is a large size box, the fourth bottom panel 260*d* can comprise two or more of the tabs 968 extending therefrom and two or more corresponding slots 969 formed at the bend line 262 between the second side panel 110*b* and the second bottom panel 260*b*. Other aspects of the dual use box 100, such as the aspect shown in FIGS. 1-8 and 10-13 may not comprise the tab(s) 968 and slot(s) 969.

FIGS. 10A and 10B illustrate a bottom perspective view and a top view of the bottom panels 260 in the folded bottom panel configuration. Referring to FIG. 10A, in example aspects, to fold the bottom panels 260 into the folded bottom panel configuration, the fourth bottom panel 260*d* can first be folded towards the interior cavity 210 (shown in FIG. 10B). In aspects comprising the tab(s) 968 and slot(s) 969, the tab(s) 968 can engage the corresponding slot(s) 969 as the bottom panels 260 are folded into the folded bottom panel configuration. For example, in aspects such as the aspect of FIG. 9, the tab 968 of the fourth bottom panel 260*d* can engage the corresponding slot 969 to retain the fourth bottom panel 260*d* in the folded orientation. The first bottom panel 260*a* can then be folded towards the interior cavity 210. Next, the second bottom panel 260*b* can be folded towards the interior cavity 210 and the fastener flap 930*a* of the second bottom panel 260*b* can be attached to the adjacent first bottom panel 260*a*. Finally, the third bottom panel 260*c* can be folded towards the interior cavity 210 and the fastener flap 930*b* of the third bottom panel 260*c* can be attached to the adjacent fourth bottom panel 260*d*. In this configuration, each of the bottom panels 260 can be oriented at about 90° relative to the side panels 110. In other aspects, the bottom panels 260 can be folded in any other suitable order that allows the bottom panels 260 to be retained in the folded bottom panel configuration. As shown in FIG. 10B, in the present aspect, the fourth bottom panel 260*d* can be folded towards the interior cavity 210 first and can be sized to almost, but not quite fully, cover the bottom opening 1117.

Figure 12:
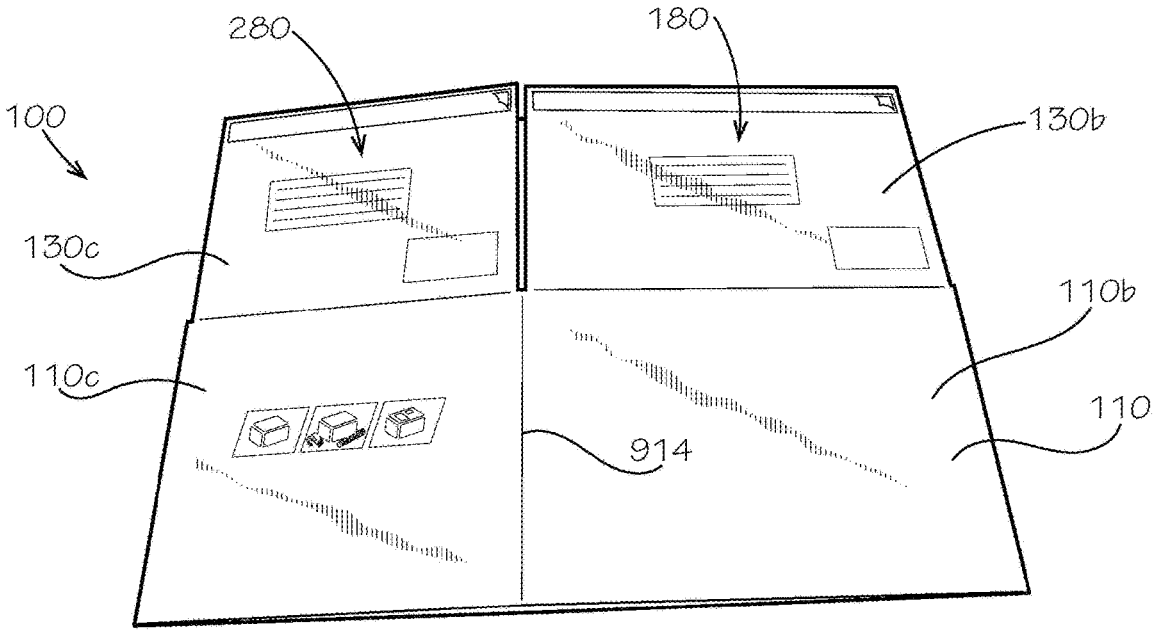
FIG. 12 is a side view of the dual use box of FIG. 1 in a folded configuration.

In some example aspects, with the bottom panels 260 configured in the folded bottom panel configuration, the bottom panels 260 can be selectively oriented in a bottom wall orientation, as shown in FIGS. 10A-10B, and a collapsed orientation, as shown in FIG. 12. In the bottom wall orientation, the dual use box 100 can be in the erect configuration, as shown in FIGS. 1-8, 10A-10B, and 13, and the bottom panels 260 can define a bottom wall 1060 of the dual use box 100. In the collapsed orientation, the dual use box 100 can be in a folded configuration, as shown in FIG. 12.

Figure 11:
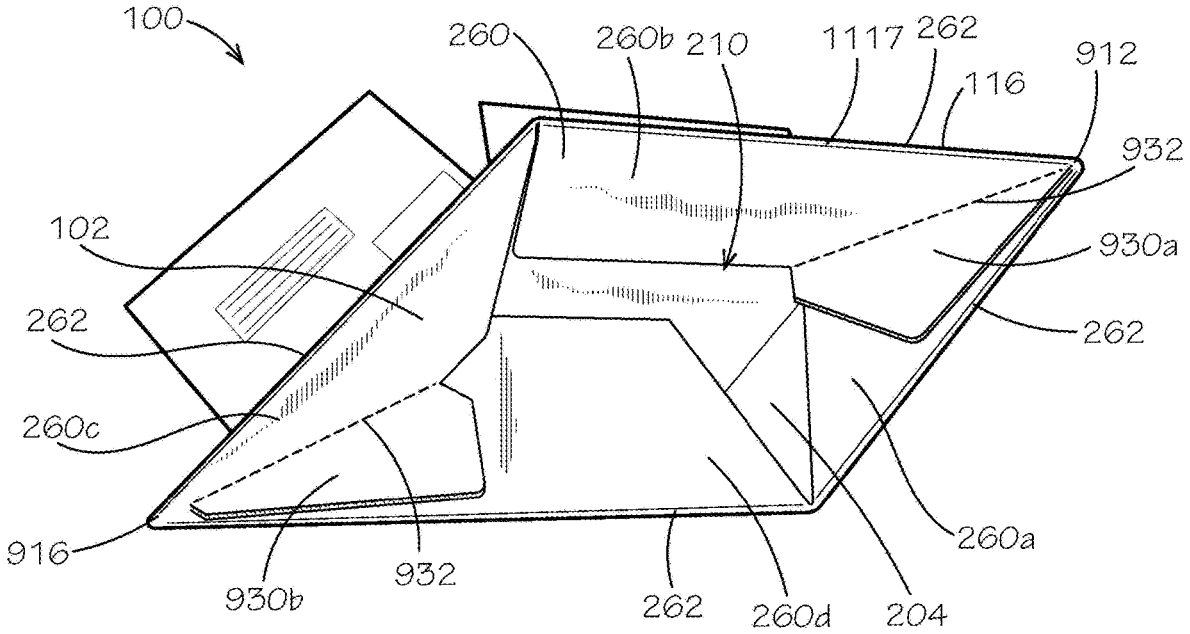
FIG. 11 is a bottom view of the dual use box of FIG. 1 in a partially folded configuration.

FIG. 11 illustrates the bottom panels 260 in a partially collapsed orientation, and as such, illustrates the dual use box 100 in a partially folded configuration. As shown, each of the fastener flaps 930*a,b* can be configured to bend relative to the corresponding second or third bottom panel 260*b,c*, respectively, at the corresponding fastener flap fold line 932. Folding the fastener flaps 930*a,b* at the corresponding fastener flap fold lines 932 can permit each of the bottom panels 260 to fold inward into the interior cavity 210 at the corresponding bottom panel fold lines 262. In the present aspect, as the bottom panels 260 fold inward, the first and fourth side panels 110*a,d* (shown in FIG. 2A) can fold towards the second and third side panels 110*b,c* (shown in FIG. 2A) at the corresponding first and third side panel fold lines 912,916.

To collapse the bottom panels 260 to the collapsed orientation, and to thus fold the dual use box 100 to the folded configuration, a user can simply push the bottom panels 260 into the interior cavity 210 at the outer surface 102 of the box 100. In some aspects, a user may also able to reach into the interior cavity 210, grip one of the bottom panels 260 (e.g., the fourth bottom panel 260*d*), and pull the bottom panels 260 into the interior cavity 210 to collapse the bottom panels 260. To reconfigure the bottom panels 260 in the bottom wall orientation, and to thus expand the dual use box 100 to the erect configuration, a user can reach into the interior cavity 210 and push the bottom panels 260 away from the interior cavity 210 at the inner surface 204 of the box 100. In some aspects, a user may also be able to grip one of the bottom panels 260 at the outer surface 102 of the box 100 and pull the bottom panels 260 out of the interior cavity 210.

FIG. 12 illustrates the dual use box 100 in the folded configuration. In the folded configuration, the bottom panels 260 (shown in FIG. 11) can be collapsed to the collapsed orientation, such that the bottom panels 260 can lie against the side panels 110. Furthermore, the first and fourth side panels 110*a,d* (shown in FIG. 2A) can be folded towards the second and third side panels 110*b,c* such that the first and fourth side panels 110*a,d* can lie adjacent to the second and third side panels 110*b,c*. In the folded configuration of the dual use box 100, the box 100 can easily stored, shipped, and/or stacked with other folded boxes.

Figure 13:
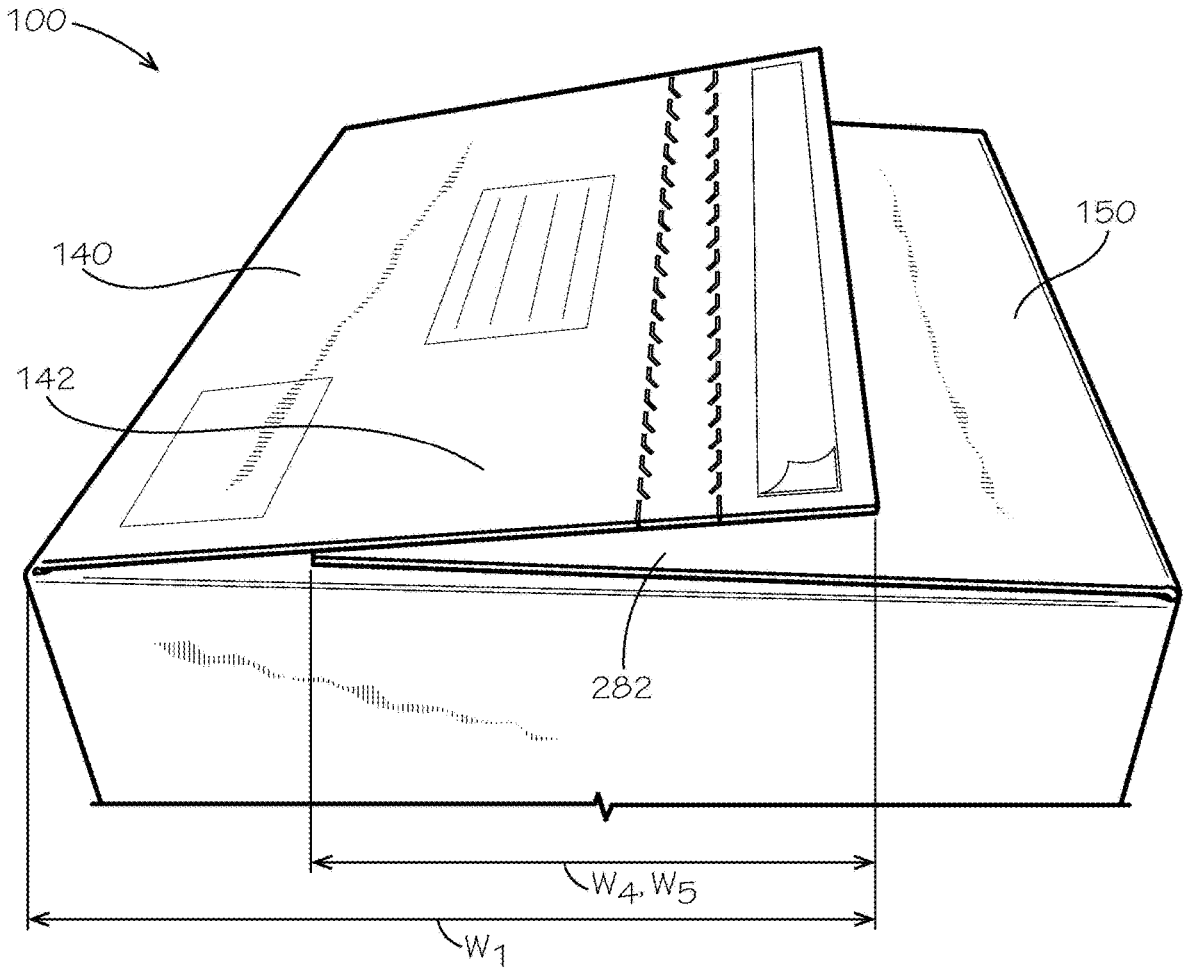
FIG. 13 is a top perspective view of a pair of primary upper panels of the dual use box of FIG. 1.

FIG. 13 is a detail view of the first primary top panel 140 folded over the second primary top panel 150, such that the primary overlapping portion 142 overlays the primary underlying portion 282. In example aspects, the primary overlapping portion 142 can define an overlapping width $W_4$ that can define about half or greater than half (as shown) of the overall width $W_1$ of the corresponding first primary top panel 140. In some aspects, an underlying width $W_5$ of the underlying portion can also define at least half of a width of the second primary top panel 150. For example, in a particular aspects, the second primary top panel 150 can also define the overall width $W_1$, and as such, the underlying width $W_5$ of the primary underlying portion 282 can define at least half of the overall width $W_1$. Furthermore, in some aspects, the underlying width $W_5$ can be about equal to the overlying width $W_4$. In some aspects, the secondary overlapping portion 242 (shown in FIG. 2A) and/or secondary underlying portion 252 (shown in FIG. 2A) can be similarly configured.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A dual use box comprising:

a side panel enclosure defining a top end and a bottom end;

a first primary top panel extending from the top end of the side panel enclosure and defining a primary overlapping portion and a primary delivery address label;

a second primary top panel extending from the top end of the side panel enclosure and defining a primary underlying portion;

a first secondary top panel extending from the top end of the side panel enclosure and defining a secondary overlapping portion and a secondary delivery address label; and a second secondary top panel extending from the top end of the side panel enclosure and defining a secondary underlying portion;

wherein:

the dual use box is configurable in a primary closed configuration and a secondary closed configuration;

in the primary closed configuration, the primary overlapping portion overlays the primary underlying portion, such that the primary delivery address label is visible;

in the secondary closed configuration, the primary underlying portion overlays the primary overlapping portion, such that at least a portion of the primary delivery address label is hidden by the primary underlying portion;

in the secondary closed configuration, the secondary overlapping portion overlays the secondary underlying portion, such that the secondary delivery address label is visible; and the first primary top panel comprises a primary adhesive, the primary adhesive configured to attach the first primary top panel to the second primary top panel in the primary closed configuration.

2. The dual use box of claim 1, wherein the first secondary top panel comprises a secondary adhesive, the secondary adhesive configured to attach the first secondary top panel to the second secondary top panel in the secondary closed configuration.

3. The dual use box of claim 2, further comprising a primary peelable backing removably covering the primary adhesive and a secondary peelable backing removably covering the secondary adhesive.

4. The dual use box of claim 1, wherein the first primary top panel further comprises a primary return address label, and wherein the first secondary top panel further comprises a secondary return address label.

5. The dual use box of claim 1, wherein the first primary top panel defines an inner primary top panel flap and an outer primary top panel flap connected to the inner primary top panel flap by a primary tear strip; and the primary overlapping portion defines the outer primary top panel flap.

6. The dual use box of claim 5, wherein the outer primary top panel flap comprises the primary adhesive, and wherein the inner primary top panel flap comprises the primary delivery address label.

7. The dual use box of claim 1, further comprising indicia indicating that the dual use box can be used in the secondary closed configuration after using the dual use box in the primary closed configuration.

8. The dual use box of claim 7, wherein:

the indicia is formed on the primary underlying portion of the second primary top panel; and the indicia is not visible in the primary closed configuration.

9. A dual use box comprising:

a side panel enclosure defining a top end and a bottom end, the side panel enclosure comprising a first side panel, a second side panel, a third side panel, and a fourth side panel;

a first primary top panel extending from the first side panel at the top end of the side panel enclosure and comprising a primary address label;

a second primary top panel extending from the third side panel at the top end of the side panel enclosure;

a first secondary top panel extending from the second side panel at the top end of the side panel enclosure and comprising a secondary address label;

a second secondary top panel extending from the fourth side panel at the top end of the side panel enclosure; and a plurality of bottom panels extending from the bottom end of the side panel enclosure;

wherein, in a folded configuration of the dual use box:

the first side panel is folded to confront the fourth side panel and the second side panel is folded to confront the third side panel;

the first primary top panel and the first secondary top panel face outward such that the primary address label and the secondary address label are visible;

the first primary top panel confronts the second secondary top panel, and the first secondary top panel confronts the second primary top panel; and the plurality of bottom panels are folded to lie against the side panel enclosure.

10. The dual use box of claim 9, wherein:

the plurality of bottom panels comprise a first bottom panel extending from the first side panel, a second bottom panel extending from the second side panel, a third bottom panel extending from the third side panel, and a fourth bottom panel extending from the fourth side panel; and in the folded configuration:

the first bottom panel is folded to lie against the first side panel;

the second bottom panel is folded to lie against the second side panel;

the third bottom panel is folded to lie against the third side panel; and the fourth bottom panel is folded to lie against the fourth side panel.

11. The dual use box of claim 10, wherein, in the folded configuration:

the first bottom panel and the fourth bottom panel are disposed between the first side panel and the fourth side panel; and the second bottom panel and the third bottom panel are disposed between the second side panel and the third side panel.

12. The dual use box of claim 9, wherein the first primary top panel further comprises a primary return address label, and wherein the first secondary top panel further comprises a secondary return address label.

13. The dual use box of claim 12, wherein:

the first primary top panel comprises a primary adhesive configured to attach the first primary top panel to the second primary top panel in a primary closed configuration; and the first secondary top panel comprises a secondary adhesive configured to attach the first secondary top panel to the second secondary top panel in a secondary closed configuration.

14. The dual use box of claim 13, wherein:

the first primary top panel defines an inner primary top panel flap and an outer primary top panel flap connected to the inner primary top panel flap by a primary tear strip; and the first secondary top panel defines an inner secondary top panel flap and an outer secondary top panel flap connected to the inner secondary top panel flap by a secondary tear strip.

15. The dual use box of claim 14, wherein:

the primary adhesive is disposed on the outer primary top panel flap;

the secondary adhesive is disposed on the outer secondary top panel flap;

the primary address label is disposed on the inner primary top panel flap; and the secondary address label is disposed on the inner secondary top panel flap.

16. A dual use box comprising:

a side panel enclosure defining a top end and a bottom end, the side panel enclosure comprising a first side panel, a second side panel, a third side panel, and a fourth side panel;

a first primary top panel extending from the first side panel at the top end of the side panel enclosure and comprising a primary address label;

a second primary top panel extending from the third side panel at the top end of the side panel enclosure;

a first secondary top panel extending from the second side panel at the top end of the side panel enclosure and comprising a secondary address label; and a second secondary top panel extending from the fourth side panel at the top end of the side panel enclosure;

wherein, in a folded configuration of the dual use box:

the first side panel is folded to confront the fourth side panel and the second side panel is folded to confront the third side panel;

the first primary top panel and the first secondary top panel face outward such that the primary address label and the secondary address label are visible;

the first primary top panel further comprises a primary return address label, and wherein the first secondary top panel further comprises a secondary return address label;

the first primary top panel comprises a primary adhesive configured to attach the first primary top panel to the second primary top panel in a primary closed configuration;

the first secondary top panel comprises a secondary adhesive configured to attach the first secondary top panel to the second secondary top panel in a secondary closed configuration;

the first primary top panel defines an inner primary top panel flap and an outer primary top panel flap connected to the inner primary top panel flap by a primary tear strip;

the first secondary top panel defines an inner secondary top panel flap and an outer secondary top panel flap connected to the inner secondary top panel flap by a secondary tear strip;

the primary adhesive is disposed on the outer primary top panel flap;

the secondary adhesive is disposed on the outer secondary top panel flap;

the primary address label is disposed on the inner primary top panel flap; and the secondary address label is disposed on the inner secondary top panel flap.

* * * * *